US009121596B2

(12) United States Patent
Alexiou et al.

(10) Patent No.: US 9,121,596 B2
(45) Date of Patent: Sep. 1, 2015

(54) LED LAMP ASSEMBLY

(75) Inventors: Alexandra Alexiou, Frederiksberg C (DK); Jacob Willer Tryde, Valby (DK)

(73) Assignee: Alexiou & Tryde Holding ApS, Valby (DK)

( * ) Notice: Subject to any disclaimer, the term of this patent is extended or adjusted under 35 U.S.C. 154(b) by 319 days.

(21) Appl. No.: 13/695,400

(22) PCT Filed: May 4, 2011

(86) PCT No.: PCT/EP2011/057125

§ 371 (c)(1),
(2), (4) Date: Apr. 3, 2013

(87) PCT Pub. No.: WO2011/138363

PCT Pub. Date: Nov. 10, 2011

(65) Prior Publication Data

US 2013/0221846 A1 Aug. 29, 2013

(30) Foreign Application Priority Data

May 5, 2010 (DK) ..... 2010 00391

(51) Int. Cl.
*H01J 13/46* (2006.01)
*F21V 29/00* (2015.01)
(Continued)

(52) U.S. Cl.
CPC ..... *F21V 29/2268* (2013.01); *F21V 29/004* (2013.01); *F21V 29/75* (2015.01);
(Continued)

(58) Field of Classification Search
CPC F21K 9/30; F21Y 2111/004; F21Y 2111/005
See application file for complete search history.

(56) References Cited

U.S. PATENT DOCUMENTS 831,311 A 9/1906 Strootmen et al.
7,874,702 B2 * 1/2011 Shuai et al. ..... 362/294
(Continued)

FOREIGN PATENT DOCUMENTS

CN 201180968 Y 1/2009
CN 201273552 Y 7/2009
(Continued)

OTHER PUBLICATIONS

International Search Report for PCT/EP2011/057125, mailed Sep. 12, 2011.
(Continued)

*Primary Examiner* — Jeffrey Zweizig
(74) *Attorney, Agent, or Firm* — Brinks Gilson & Lione

(57) ABSTRACT

There is provided a LED lamp assembly (1300) comprising a heat sink (1301) having a cooling structure with an outer circumference part and a center part (1311), which supports a plurality of LEDs, and the material thickness of the cooling structure increases inwards from the outer circumference part to the center of the heat sink. The LED assembly may further comprise a lampshade supported by the outer circumference part of the heat sink. There is also provided a LED lamp assembly comprising a heat sink having a center, an outer circumference part supporting a plurality of LEDs, and a cooling structure with a number of vent-holes allowing passage of air, the cooling structure supported by the outer circumference part and extending inwards towards the center from the outer circumference part. Furthermore, a LED lamp assembly comprises an outer circumference part which supports a plurality of LEDS and cooling fans extending inwards and tilted relatively to a center axis, the material thickness of the cooling fins decreases inwards from the outer circumference.

20 Claims, 25 Drawing Sheets

(51) Int. Cl.

| | |
|---|---|
| ***F21V 29/75*** | (2015.01) |
| ***F21V 29/78*** | (2015.01) |
| ***F21V 29/83*** | (2015.01) |
| *F21Y 101/02* | (2006.01) |
| *F21Y 103/02* | (2006.01) |
| *F21Y 111/00* | (2006.01) |
| *F21V 29/77* | (2015.01) |

(52) U.S. Cl.

CPC ..... *F21V 29/78* (2015.01); *F21V 29/83* (2015.01); *F21V 29/773* (2015.01); *F21Y 2101/02* (2013.01); *F21Y 2103/022* (2013.01); *F21Y 2111/005* (2013.01)

(56) References Cited

U.S. PATENT DOCUMENTS

| | | | | |
|---|---|---|---|---|
| 8,096,677 | B2 * | 1/2012 | Fields et al. | 362/231 |
| 8,354,779 | B2 * | 1/2013 | Falicoff et al. | 313/35 |
| 2005/0168985 | A1 * | 8/2005 | Chen | 362/241 |
| 2007/0041220 | A1 * | 2/2007 | Lynch | 362/646 |
| 2008/0246383 | A1 * | 10/2008 | Chang et al. | 313/36 |
| 2009/0230833 | A1 * | 9/2009 | Kao et al. | 313/1 |
| 2009/0323338 | A1 * | 12/2009 | Agurok et al. | 362/247 |
| 2010/0084116 | A1 * | 4/2010 | Chen | 165/80.3 |

FOREIGN PATENT DOCUMENTS

| | | | |
|---|---|---|---|
| DE | 202009017728 | U1 | 4/2010 |
| EP | 1510754 | A2 | 3/2005 |
| WO | 2008119392 | A1 | 10/2008 |
| WO | 2008148029 | A1 | 12/2008 |

OTHER PUBLICATIONS

Written Opinion for PCT/EP2011/057125, mailed Sep. 12, 2011.

* cited by examiner

Fig. 11a
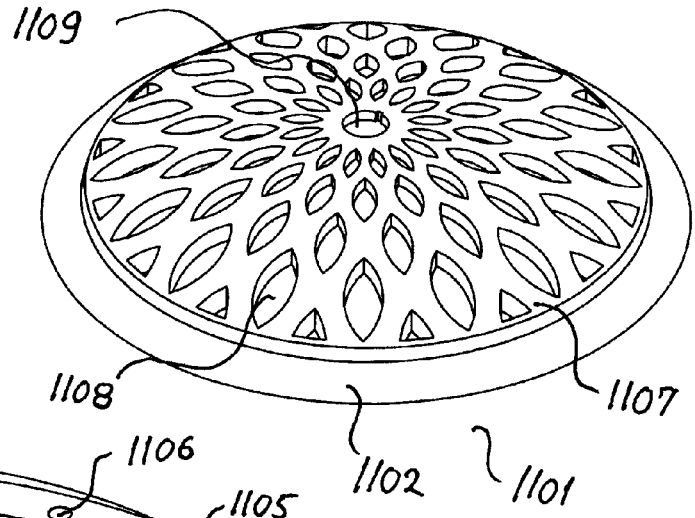
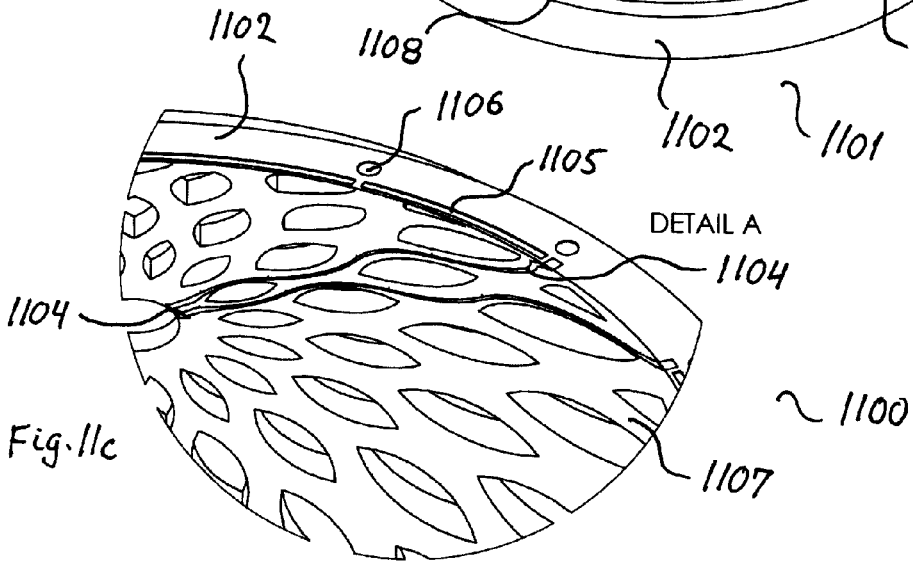
Fig. 11c
Fig. 11b
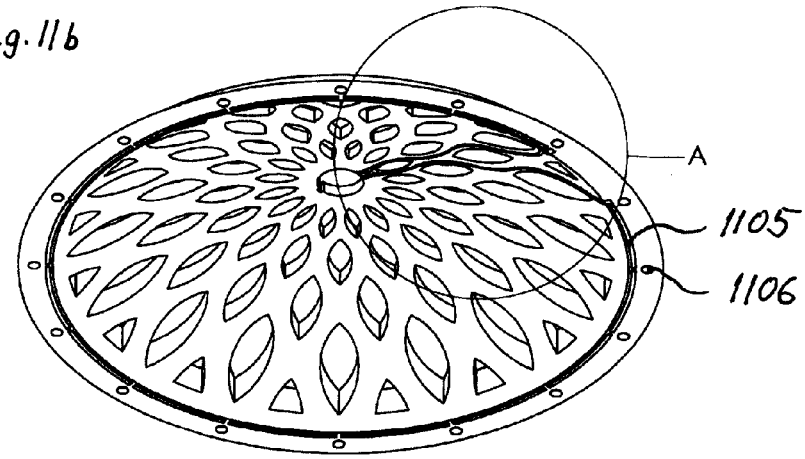

Fig. 14a
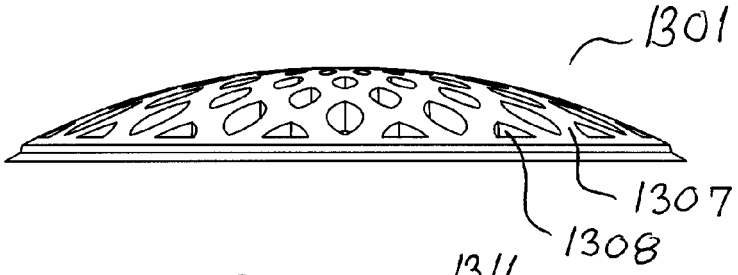
Fig. 14b
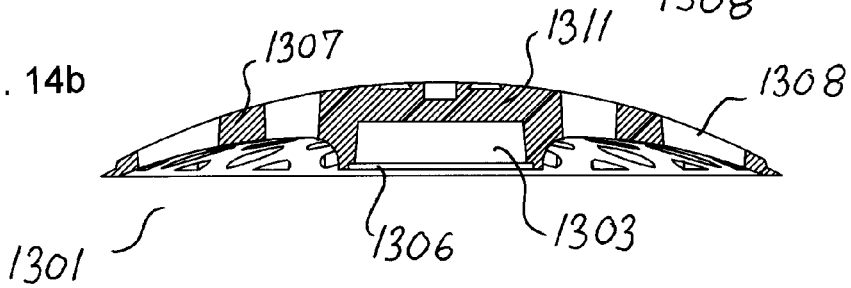
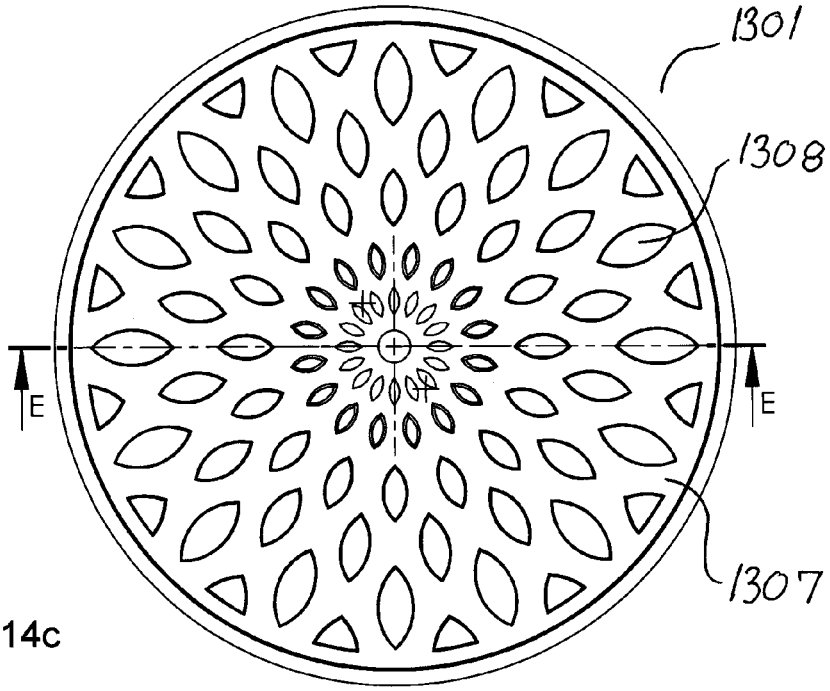
Fig. 14c

Fig. 15b
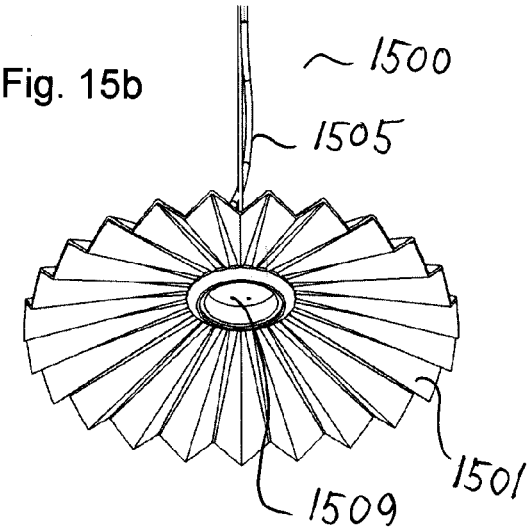
Fig. 15a
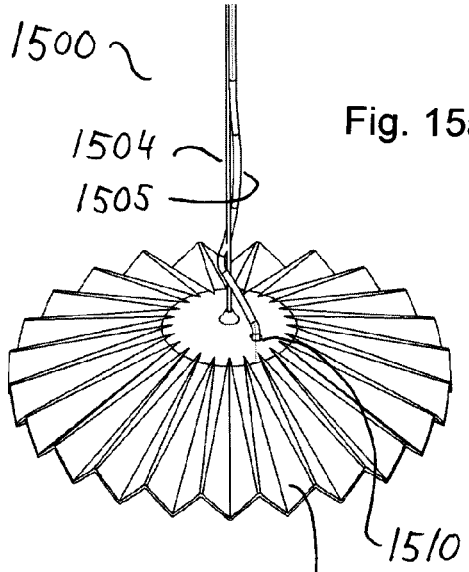
Fig. 15c
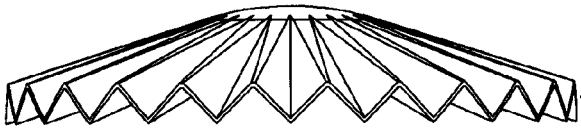
Fig. 15d
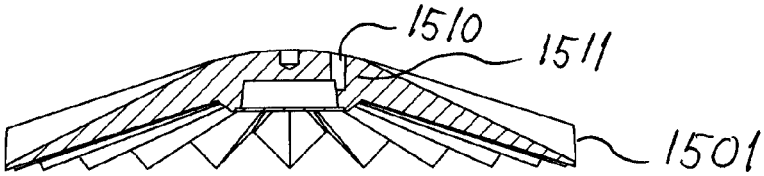
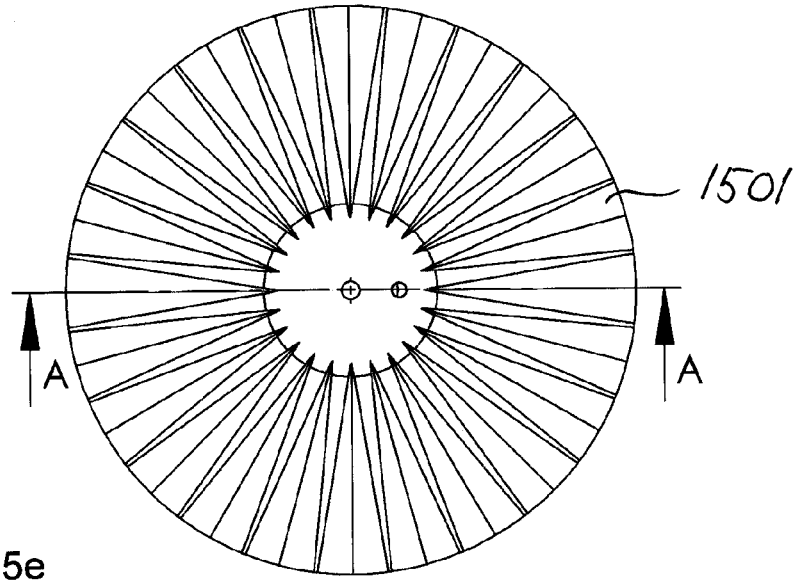
Fig. 15e Fig. 17a
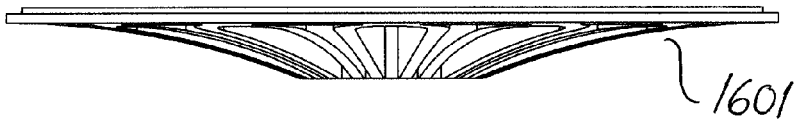
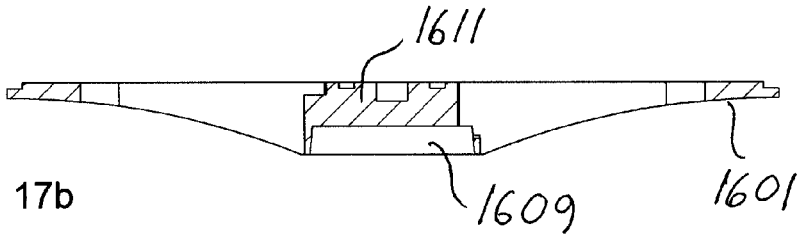
Fig. 17b
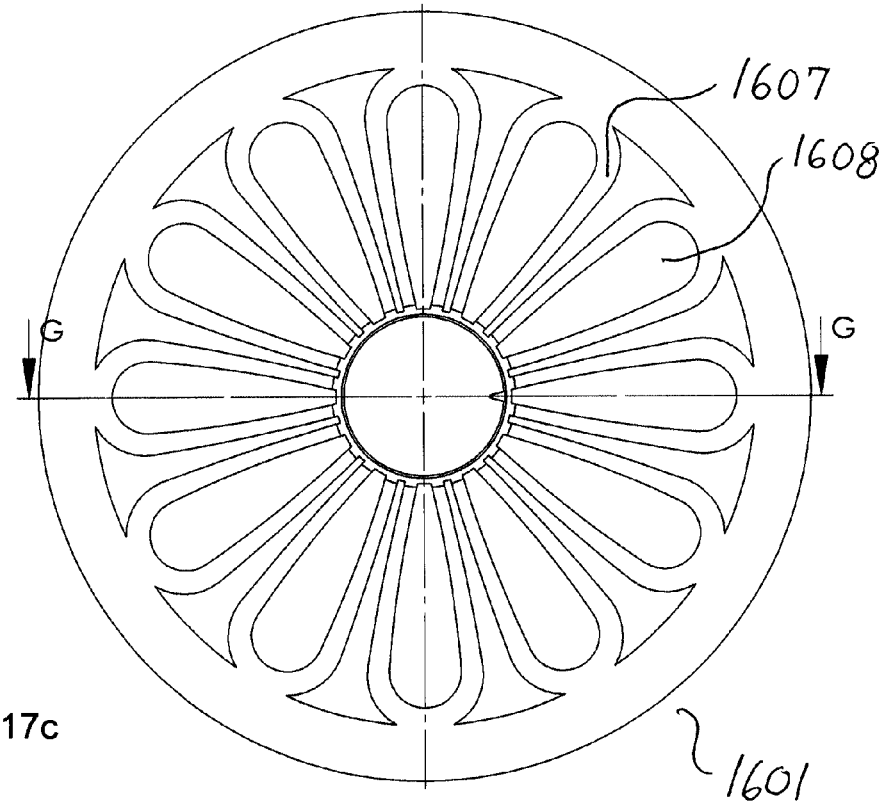
Fig. 17c

LED LAMP ASSEMBLY

RELATED APPLICATIONS

This application claims the benefit under 35 U.S.C. §371 of International Patent Application No. PCT/EP2011/057125, which has an International Filing Date of May 4, 2011, which claims priority to Danish Patent Application No. PA 2010 00391, filed May 5, 2010, the contents of all of which are incorporated herein by reference in their entirety.

FIELD OF INVENTION

The present invention relates to a light emitting diode (LED) lamp assembly, and more particularly to LED lamp assembly having a heat sink supporting a plurality of LEDs.

BACKGROUND OF THE INVENTION

The technology of light emitting diodes, LEDs, has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of the heat sink to dissipate heat generated by the LEDs. The outer surface of the heat sink generally is a plane and the LEDs are arranged close to each other, whereby considerable heat is generated. When the LED lamp works, the LEDs mounted on the planar outer surface of the heat sink only form a flat light source.

Thus, it is desirable to devise a new LED lamp assembly having a heat sink providing an effective dissipation of the generated heat. It is also desirable to devise a new LED lamp assembly providing an even and broad illumination of the light generated by the LEDs.

SUMMARY OF THE INVENTION

According to a first aspect of the invention there is provided a LED lamp assembly comprising: a heat sink having a cooling structure with an outer circumference part and a centre part, which centre part supports a plurality of LEDs, and wherein the material thickness of the cooling structure increases inwards from the outer circumference part to the centre of the heat sink. The cooling structure may comprise a number of vent-holes allowing passage of air, and the size of the vent-holes may decrease inwards towards the centre of the heat sink. The vent-holes or openings may have an oblong shape.

It is within an embodiment of the first aspect of the invention that the cooling structure has the form of an inverted bowl, and it is within another embodiment of the first aspect of the invention that the upper surface of the cooling structure is flat.

According to an embodiment of the first aspect of the invention, the area taken up by the vent-holes compared to the area of the rigid cooling part surrounding the vent-holes increases inwards from the outer circumference part to the centre of the heat sink.

According to one or more embodiments of the first aspect of the invention, the LED assembly may further comprise a lampshade supported by the outer circumference part of the heat sink.

The first aspect of the invention also covers an embodiment, wherein the cooling structure has a folded or pleat like form. Here, the cooling structure may be closed without vent-openings, and the cooling structure may have the form of an inverted bowl.

It is within one or more embodiments of the first aspect of the invention that the bottom of the centre part of the heat sink is adapted to support the LED light source. The LED light source may be a PrevaLED® Core light engine. The bottom of the centre part of the heat sink may also hold a diffuser plate below the LED light source.

For the first aspect of the invention it is preferred that the heat sink has a substantially circular outer circumference.

According to a second aspect of the present invention there is provided a LED lamp assembly comprising: a heat sink supporting a plurality of LEDs, wherein the heat sink has an outer circumference part supporting at least part of the LEDs. It is preferred that the heat sink has a cooling structure allowing passage of air, which cooling structure is supported by the outer circumference part and extends inwards from the outer circumference part. The cooling structure may comprise a number of vent-holes and/or a plurality of cooling fins.

Thus, the second aspect of the invention also covers a LED lamp assembly comprising: a heat sink having a centre, an outer circumference part supporting a plurality of LEDs, and a cooling structure with a number of vent-holes allowing passage of air, said cooling structure being supported by the outer circumference part and extending inwards towards the centre from the outer circumference part. The size of the vent-holes may decrease inwards towards the centre of the heat sink. The cooling structure may have the form of an inverted bowl.

For embodiments of the second aspect of the invention it is preferred that the material thickness of the cooling structure decreases inwards from the outer circumference part to the centre of the heat sink.

It is preferred that a major part or all of the LEDs are supported by the outer circumference part of the heat sink. Preferably, the outer circumference part of the heat sink is circumferentially closed, but the present invention also covers embodiments wherein the outer circumference part of the heat sink is made up of two or more separated circumference sub-parts.

According to an embodiment of the second aspect of the invention, the heat sink may have a plurality of cooling fins being supported by the outer circumference part and extending inwards from the outer circumference part For embodiments of the second aspect of the invention, wherein the cooling structure comprises a plurality of cooling fins extending inwards from the outer circumference part, then at least part of or all of the cooling fins may be tilted or partly tilted relatively to a centre axis of the heat sink. Here, the cooling fins may be arranged so that a lower surface part of a first cooling fin is partly shielding an upper surface part of a following second cooling fin, when looking downwards at the top surface of the heat sink.

Thus, the second aspect of the invention also covers a LED lamp assembly comprising: a heat sink having a centre and an outer circumference part, which outer circumference part supports a plurality of LEDS, and which outer circumference part further supports a plurality of cooling fins extending inwards towards the centre from the outer circumference part, wherein at least part of or all of the cooling fins are tilted or partly tilted relatively to a centre axis of the heat sink, and wherein the material thickness of the cooling fins decreases inwards from the outer circumference part towards the centre of the heat sink.

It is preferred that the tilt angle of the cooling fins decrease from the outer circumference part towards the centre of the heat sink. The tilt angle of the cooling fins may at the outer circumference part be in the range of 10-45°, such as in the range of 20-35°, such as in the range of 25-30°. The tilt angle of the cooling fins at the end of the cooling fins, close to the centre, may be below 20°, such as below 10°.

For embodiments of the second aspect of the invention wherein the cooling structure comprises a plurality of cooling fins extending inwards from the outer circumference part, then the width or cross sectional area of the cooling fins may decrease in the inward direction from the outer circumference part towards the centre of the heat sink. It also within one or more embodiments of the second aspect of the invention that the cooling fins have an upper surface, a lower surface, and first and second side surfaces, and that, for at least a part of or for all of the cooling fins, the area of each side surface is larger than the area of the upper surface and larger than the area of the lower surface.

For embodiments of the second aspect of the invention having a cooling structure with vent-holes, then the area taken up by the vent-holes compared to the area of the rigid cooling part surrounding the vent-holes may increase inwards from the outer circumference part to the centre of the heat sink.

For both the first and second aspects of the invention it is preferred that the outer circumference part of the heat sink is made of an electrically non-conducting material, such as a ceramic material. It is also preferred that the cooling structure is made of an electrically non-conducting material such as a ceramic material. Thus, the whole heat sink may be made of an electrically non-conducting material such as a ceramic material. The electrically non-conducting material or ceramic material may in one embodiment be aluminium nitride, AlN.

It is within a preferred embodiment of the second aspect of the invention that at least part of or all of the LEDs are surface-mount LEDs. The surface-mount LEDs may on the back side have a cathode pad, an anode pad and a thermal pad, and the thermal pads may be thermally contacting or mounted to the outer circumference part of the heat sink.

The second aspect of the invention also covers one or more embodiments, wherein the heat sink is made of an electrically conductive material, such as aluminium, copper or zirconium. Here, the LEDs may be mounted on a printed circuit board, which may be a rigid or a flexible printed circuit board, and which may be mounted to the outer circumference part of the heat sink.

The second aspect of the invention also covers embodiments where at least the outer circumference part of the heat sink or the whole heat sink is made of an electrically non-conducting material, such as a ceramic material, and where the LEDs are mounted on a printed circuit board, which may be a rigid or a flexible printed circuit board, and which may be mounted to the outer circumference part of the heat sink.

According to an embodiment of the second aspect of the invention, then an electrically conducting layer, plate or ring may be arranged at the outer circumference part of the heat sink and provide at hold for the LEDs supported by this outer circumference. The conducting plate or ring may be secured to the top of the outer circumference part of the heat sink by a number of conically shaped pins inserted into corresponding holes from the bottom of the heat sink.

According to present invention the LEDs may be electrically connected in series, in parallel, or in a combination of serial and parallel connections. In a preferred embodiment the LEDs may be divided into a number of groups with the LEDs of the same group being electrically connected in series, with each group of series connected LEDs have first and second voltage inputs. For embodiments having the electrically conducting layer, plate or ring, the first voltage inputs may be electrically conductive connected to the conducting plate or ring. The second voltage inputs may be electrically connected to corresponding contact plugs arranged at the outer circumference part of the heat sink.

The second aspect of the invention further covers one or more embodiments, wherein the assembly further comprises a base for holding the heat sink. The base may also be adapted for providing supply of electrical power to the LEDs. The base may have a number of legs for holding the heat sink, and these legs may also be adapted for providing the supply of electrical power to the LEDs. For embodiments having groups of serially connected LEDs, then the number of base-legs may equal the number of LED groups. It is preferred that the base holds driver circuitry for supplying a DC voltage to the LEDs. The driver circuitry may comprise an AC to DC converter for converting a high-voltage AC input into a DC output for supplying the LEDs. According to a preferred embodiment the base has a retrofit adaptor being compatible with Edison type sockets.

The second aspect of the invention also covers one or more embodiments wherein the heat sink is made of an electrically non-conductive material, such as a ceramic material, and thick film conductors are printed directly on the heat sink for supplying power to the LEDs. Here thick film conductors may be printed directly on non-conductive parts of the heat sink and connected to cathode and anode pads of the surface-mount LEDs for supplying power to the LEDs.

According to one or more embodiments of the second aspect of the invention, the heat sink may further have a centre part, which is also supporting the cooling fins. The heat sink may be made of an electrically non-conductive material, such as a ceramic material, and thick film conductors may be printed along the cooling fins allowing a voltage supply to the LEDs. The heat sink may alternatively be made of an electrically conductive material, such as aluminium, and electrically conductive wiring or lines may be arranged at an insulating layer being provided between the heat sink and the conductive wiring or lines, where the conductive wiring or lines are arranged for supplying power to the LEDs.

Also for embodiments of the second aspect of the invention is it preferred that the heat sink has a substantially circular outer circumference.

It should be understood that the second aspect of the present invention covers assemblies having different directions of the emitted light from the LEDs. According to a first embodiment, the LEDs supported by the outer circumference of the heat sink may be arranged so that the main direction of the emitted light is perpendicular to a centre axis of the heat sink. According to another embodiment, the LEDs supported by the outer circumference of the heat sink may be arranged so that the main direction of the emitted light is parallel to a centre axis of the heat sink. In yet another embodiment, the LEDs supported by the outer circumference of the heat sink may be arranged so that the main direction of the emitted light is tilted when compared to a centre axis of the heat sink.

The second aspect of the presenting also covers one or more embodiments, wherein the LED lamp assembly further comprises lenses or a lens being arranged in front of at least part of the LEDs being supported by the outer circumference of the heat sink. Preferably, the lens/lenses covers/cover the LEDs, which are supported by the outer circumference of the heat sink. It is also preferred that the lens/lenses is/are made in one piece. In a preferred embodiment, then for each LED or at least part of the LEDs a corresponding outwardly pointing convex part is formed on the inner surface part of the lens/lenses facing the LED. It is preferred that the lens/lenses is/are made of Silicone. The lens/lenses may be formed so as to spread out the diode light at an angle being wider than the light emission angle of the LEDs or the viewing angle of the LEDs.

The lens or lenses may be formed so as to spread out the diode light at an angle or a wide angle in a main direction equal to the main direction of the light received from the LEDs. However, the lens/lenses may also be formed so as to spread out the diode light in a main direction being at an angle relative to the main direction of the light received from the LEDs. Here, the lens/lenses may be formed so as to spread out the diode light in a main direction being substantially perpendicular to the main direction of the light received from the LEDs. Furthermore, the lens/lenses may be formed so as to spread out the diode light in at least two different main directions, which may be two substantially opposite main directions, and which again may be substantially perpendicular to the main direction of the light received from the LEDs.

According to a third aspect of the present invention there is provided a LED lamp assembly comprising: a heat sink supporting a plurality of LEDs, wherein lenses or a lens are/is arranged in front of at least part of the LEDs. Here, the lens/lenses may be made in one piece, and it may have a substantially ring- or tubular shaped form. The third aspect of the invention covers one or more embodiments, wherein, for each LED or at least part of the LEDs or all of the LEDs, a corresponding outwardly pointing convex part is formed on the inner surface of the lens/lenses, which inner surface is facing the LED. Also for the third aspect of the invention is it preferred that the lens/lenses is/are made of Silicone. According to a preferred embodiment of the third aspect of the invention the heat sink may have an outer circumference part supporting at least part of the LEDs. Here, the outer circumference part of the heat sink may be circumferentially closed. Preferably, lenses, a lens or a lens part are/is arranged in front of each of the LEDs.

The third aspect of the invention covers one or more embodiments wherein lens/lenses are formed so as to spread out the diode light at an angle being wider than the light emission angle of the LEDs.

It is within one or more embodiments of the third aspect of the invention that the lens/lenses are formed so as to spread out the diode light at a wide angle in a main direction equal to the main direction of the light received from the LEDs. The lens/lenses may alternatively be formed so as to spread out the diode light in a main direction being at an angle relative to the main direction of the light received from the LEDs. Here, the lens/lenses may be formed so as to spread out the diode light in a main direction being substantially perpendicular to the main direction of the light received from the LEDs. The third aspect of the invention further covers one or more embodiments, wherein the lens/lenses are formed so as to spread out the diode light in at least two different main directions, which may be two substantially opposite main directions, and where said two opposite main directions may be substantially perpendicular to the main direction of the light received from the LEDs.

According to a fourth aspect of the invention there is provided a LED lamp assembly comprising a heat sink supporting a plurality of LEDs, wherein at least part of the LEDs are surface-mount LEDs, which on the back side have a cathode pad, an anode pad and a thermal pad, and wherein the thermal pads are thermally contacting or mounted to the heat sink. It is preferred that the heat sink or the part of the heat sink being in contact with the LEDs is made of an electrically non-conducting material. Thick film conductors may be printed directly on the non-conductive parts of the heat sink and connected to cathode and anode pads of the surface-mount LEDs for supplying power to the LEDs.

The fourth aspect of the invention also covers one or more embodiments, wherein the surface-mount LEDs are divided into a number of groups with the LEDs of the same group being electrically connected in series, and wherein thick film conductors are printed directly on non-conductive parts of the heat sink and connected to cathode and anode pads of the surface-mount LEDs for providing said series connection of the LEDs.

According to an embodiment of the fourth aspect of the invention, the heat sink has a non-conducting outer circumference part supporting the surface-mount LEDs, where the outer circumference part of the heat sink may be circumferentially closed. Preferably, the heat sink has a cooling structure allowing passage of air, which cooling structure is supported by the outer circumference part and extends inwards from the outer circumference part. The cooling structure may comprise a number of vent-holes and/or a plurality of cooling fins. According to an embodiment of the fourth aspect of the invention, an electrically conducting plate or ring is arranged at the outer circumference part of the heat sink, and a first voltage input to the LEDs may provided via said plate or ring.

For assemblies according to the fourth aspect of the invention it is preferred that the non-conducting parts of the heat sink is made of a ceramic material.

It should be understood that the for the embodiments of the present invention, the expression light emitting diodes, LEDs, also covers organic light emitting diodes, OLEDs.

BRIEF DESCRIPTION OF THE DRAWINGS

FIGS. 11*a-c* illustrate a LED lamp assembly according to a fourth embodiment of the invention, wherein the heat sink comprises a cooling structure with vent-holes.

FIGS. 14*a-c* illustrate a side view, a cut-through view and a top view of the heat sink of the lamp assembly of FIGS. 13*a-e,*

FIGS. 15*a-e* illustrate a lamp assembly according to a sixth embodiment of the invention, wherein the heat sink has a folded cooling structure, FIGS. 17*a-c* illustrate a side view, a cut-through view and a bottom view of the heat sink of the lamp assembly of FIGS. 16*a-d*, and FIGS. 18*a* and *b* are top and bottom views of a LED light source of the type PrevaLED® Core light engines.

DETAILED DESCRIPTION OF EMBODIMENTS

Figure 1A:
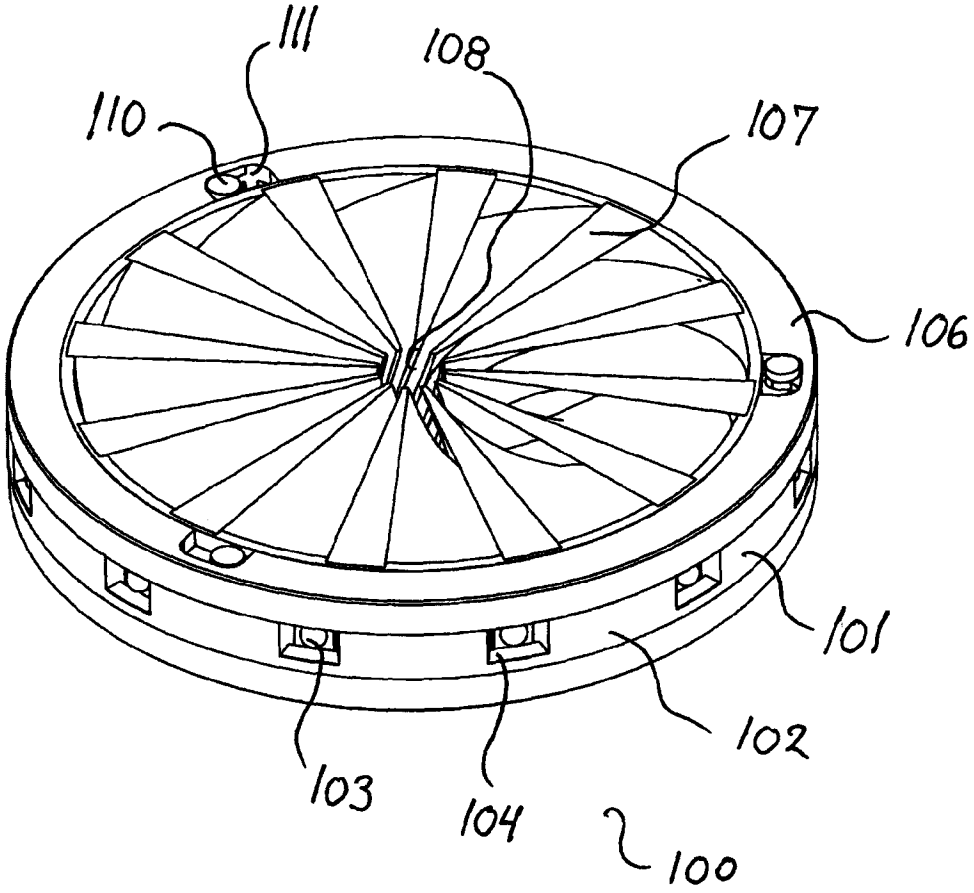
FIGS. 1*a* and 1*b* show a first and a second LED lamp assembly, respectively, according to a first embodiment of the invention, wherein the assembly holds a heat sink mounted with LEDs.
Figure 2A:
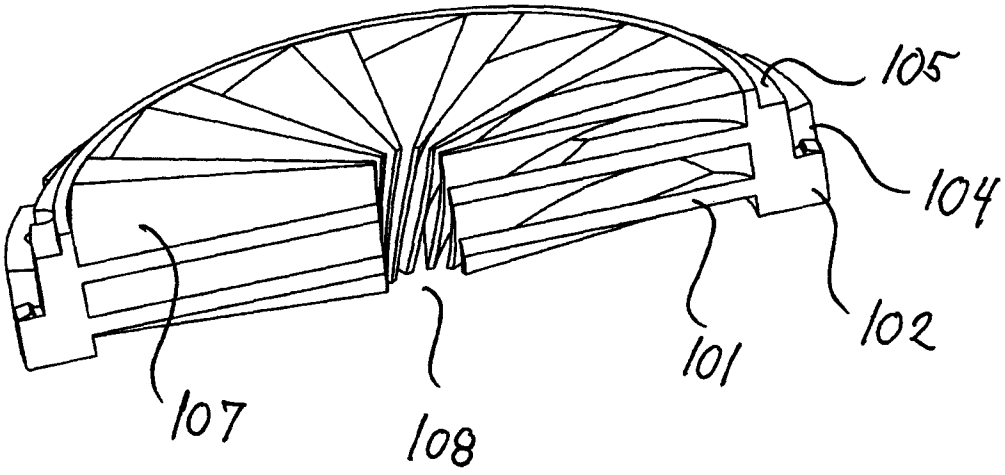
FIGS. 2*a* and 2*b* are cut through drawings of the heat sinks of FIGS. 1*a* and 1*b*, respectively.

FIG. 1*a* shows a first LED lamp assembly 100 according to a first embodiment of the invention, wherein the assembly holds a heat sink 101 mounted with LEDs, and FIG. 2*a* is a cut through drawing of the heat sink 101. The heat sink 101 has a ring-shaped outer circumference 102 supporting a number of LEDs 103. Grooves 104 are provided in the heat sink 101 for receiving the LEDs 103. For the assembly shown in FIG. 1*a*, a ring-shaped groove 105 is provided at the top of the heat sink 101 for receiving a ring-shaped top-ring 106, which may be made of a conductive material such as metal, which for example could be aluminium, copper or zirconium. The LEDs 103 are mounted on a substrate having no conductors on the front side, and the top-ring 106 is formed so as to hold the LEDs 103 in place by contacting the front side of the diode substrates. For the assembly of FIG. 1*a*, the top-ring 106 may be used for supplying ground voltage to the LEDs 103.

Three conic pins 110 may be used to keep the main body of the heat sink 101 and the top-ring together 106 via a bayonet-grip with the top-ring 106. The conically shaped pins 110 are inserted into corresponding holes 111 from the bottom of the heat sink 110, and the conic shape of the pins 110 holds the heat sink 101 and the bayonet grip holds the top-ring 106. See also FIG. 4*c*.

The heat sink 101 has a plurality of cooling fins 107, which are supported by the outer circumference part 102 and extending inwards from the outer circumference part 102. The width or cross sectional area of the cooling fins 107 decreases in the inward direction from the outer circumference part 102 towards the centre of the heat sink 108. Thus, the material thickness of the cooling fins 107 decreases in the inward direction from the outer circumference part 102 towards the centre 108. The cooling fins 107 are dimensioned so that the area of each of the side surfaces of a cooling fin 107 is larger than the area of the upper surface and larger than the area of the lower surface of the cooling fin 107. The cooling fins 107 are tilted or partly tilted relatively to a centre axis of the heat sink 101, whereby a lower surface part of a first cooling fin 107 is partly shielding an upper surface part of a following second cooling fin 107, when looking downwards at the top surface of the heat sink 101.

Figure 1B:
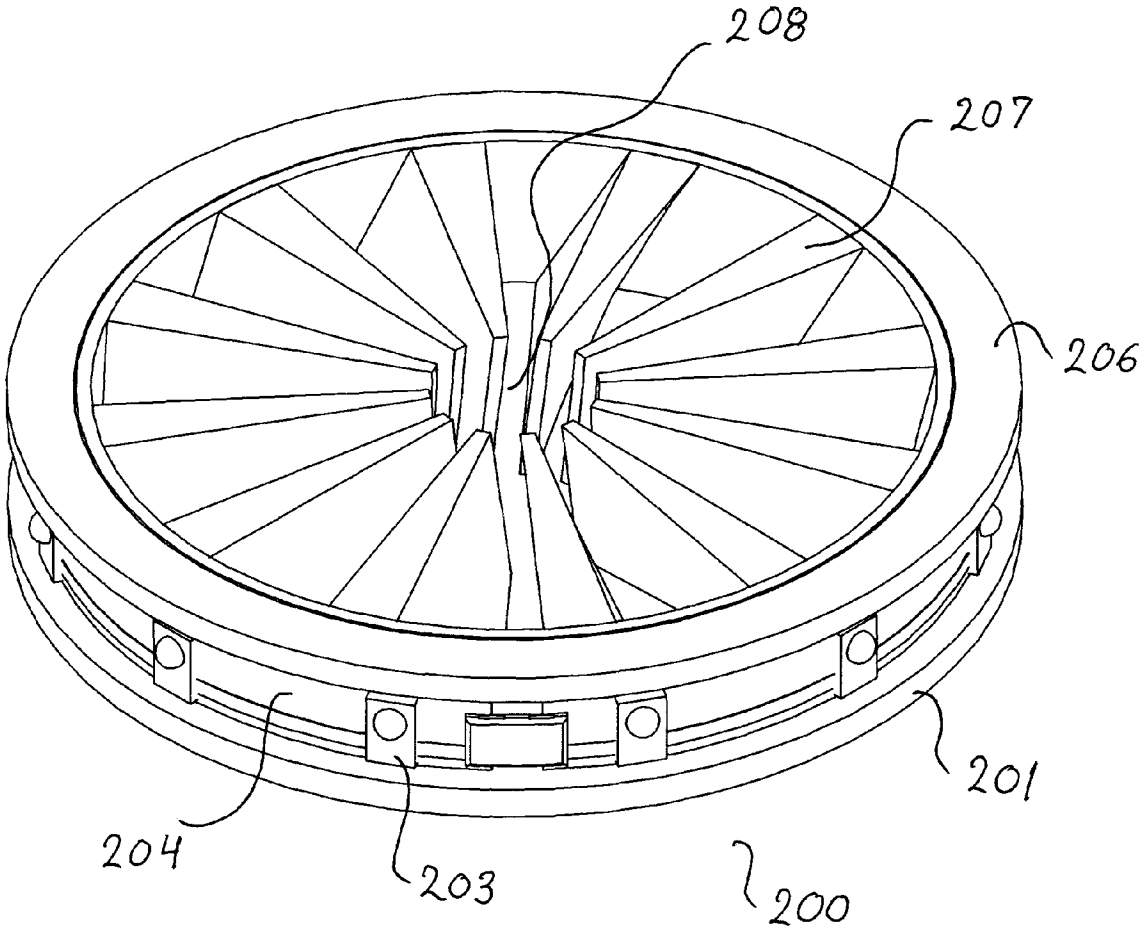
Figure 2B:
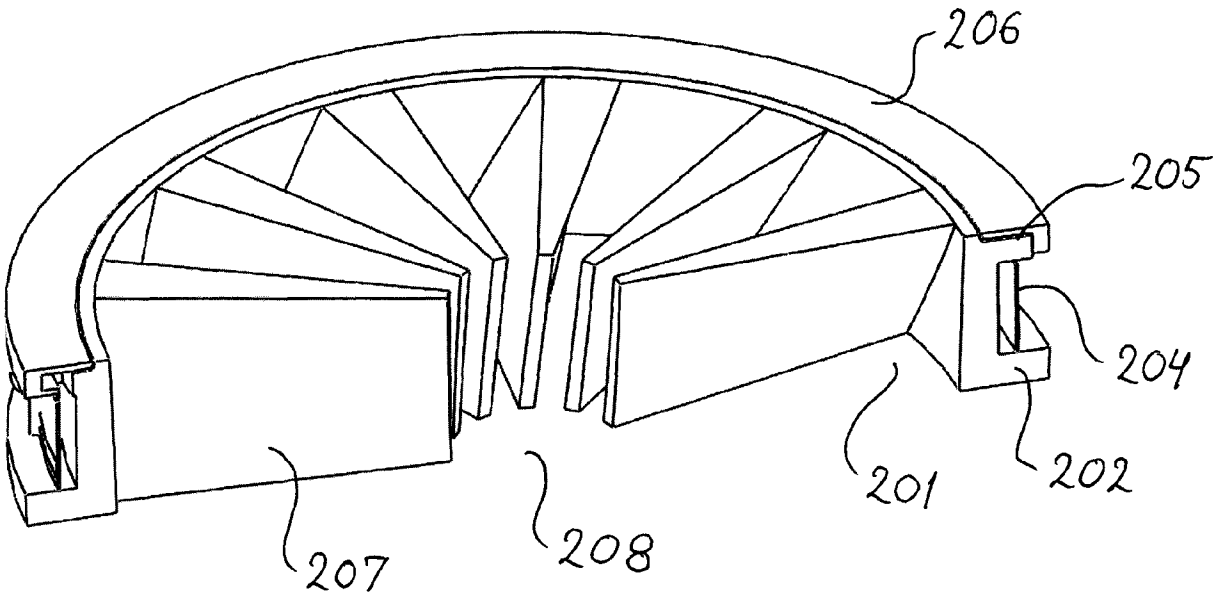

FIG. 1*b* shows a second LED lamp assembly 200 according to a first embodiment of the invention, wherein the assembly holds a heat sink 201 mounted with LEDs, and FIG. 2*b* is a cut through drawing of the assembly 200 and the heat sink 201. The heat sink 201 has a ring-shaped outer circumference 202 with a groove supporting a number of LEDs 203. For the assembly shown in FIG. 1*b*, a ring-shaped groove 205 is provided at the top of the heat sink 201 for receiving a ring-shaped top-ring 206, which may be made of a conductive material such as metal, which for example could be aluminium, copper or zirconium. The LEDs 203 are mounted on a substrate, which may be a flexible printed circuit board 204, which is arranged in the groove of the outer circumference 202. For the assembly of FIG. 1*b*, the LEDs 203 may be connected in series, and in one embodiment, at zener diode is connected in parallel with each LED 203.

Also the heat sink 201 has a plurality of cooling fins 207, which are supported by the outer circumference part 202 and extending inwards from the outer circumference part 202. The width or cross sectional area of the cooling fins 207 decreases in the inward direction from the outer circumference part 202 towards the centre of the heat sink 208. Thus, the material thickness of the cooling fins 207 decreases in the inward direction from the outer circumference part 202 towards the centre 208. The cooling fins 207 are dimensioned so that the area of each of the side surfaces of a cooling fin 207 is larger than the area of the upper surface and larger than the area of the lower surface of the cooling fin 207. The cooling fins 207 are tilted or partly tilted at an angle relatively to a centre axis of the heat sink 201. For the heat sink 201 of FIGS. 1*b* and 2*b* it is preferred that the distance between the cooling fins 207 is so large that the tilted cooling fins 207 do not shield for each other when looking downwards at the top surface of the heat sink 201.

For both heat sinks 101 and 201 it is preferred that the tilt angle of the cooling fins 107, 207 decreases from the outer circumference part 102, 202 towards the centre 108, 208, to thereby increase the airflow. The tilt angle of a cooling fin 107, 207, may be defined as the angle between a plane going through the centre axis of the heat sink 108, 208 and the upper side surface of the cooling fin 107, 207. The tilt angle of the cooling fins 107, 207 may at the outer circumference part 102, 202 be in the range of 10-45°, such as in the range of 20-35°, such as in the range of 25-30°, and at the end of the cooling fins 107, 207, close to the centre 108, 208, the tilt angle may be below 20°, such as below 10°.

It is preferred that the opening at the centre 108, 208 has a diameter of at least 10 mm.

The cooling fins 107, 207 are almost conic shaped from the outer circumference part 102, 208 towards the centre 108, 208 to obtain an even heat-dissipation and they are tilted to obtain the largest possible surface area with the given mass properties. The heat travels from the outer circumference part 102, 202 into the cooling fins 107, 207, where the heat leaves the heat sink 101, 201. Due to the convection of heat travelling upwards when leaving the heat sink 101, 201, a vacuum may be created and cold air may be drawn in from the bottom of the heat sink 101, 201.

The heat sinks 101, 201 of the LED light assemblies 100, 200, both has a center ventilation-hole 108, 208 that is connected to the ventilation area between the conic cooling-fins 107, 207, which are thickest near the LED heat source 103, 203. The heat sink constructions have one center ventilation-hole 108, 208, which creates one collective airflow stream with less resistance as opposed to several small ventilation-holes. The angled climbing cooling-fins 107, 207 force the air between the cooling-fins 107, 207 into a spin like a vortex around the center airflow stream that travels faster due to the convection and free airflow. The heat gets pulled out in between the cooling-fins 107, 207, which are angled in a way that gives them a larger surface area with the same mass-properties as vertical fins. This causes for a larger surface-area for the heat to dissipate from.

For the heat sinks 101, 201 of the assemblies of FIGS. 1*a*, 1*b*, then the outer circumference part of the heat sink 101, 201 may be made of an electrically non-conducting material. For the preferred embodiment, the cooling fins 107, 207 are also made of an electrically non-conducting material, and the whole heat sink 101, 201 may thus be made of an electrically non-conducting material. The electrically non-conducting material may be a ceramic material such as aluminium nitride, AlN. It is preferred that the heat sinks 101, 201 are made in a casting process.

Figure 2C:
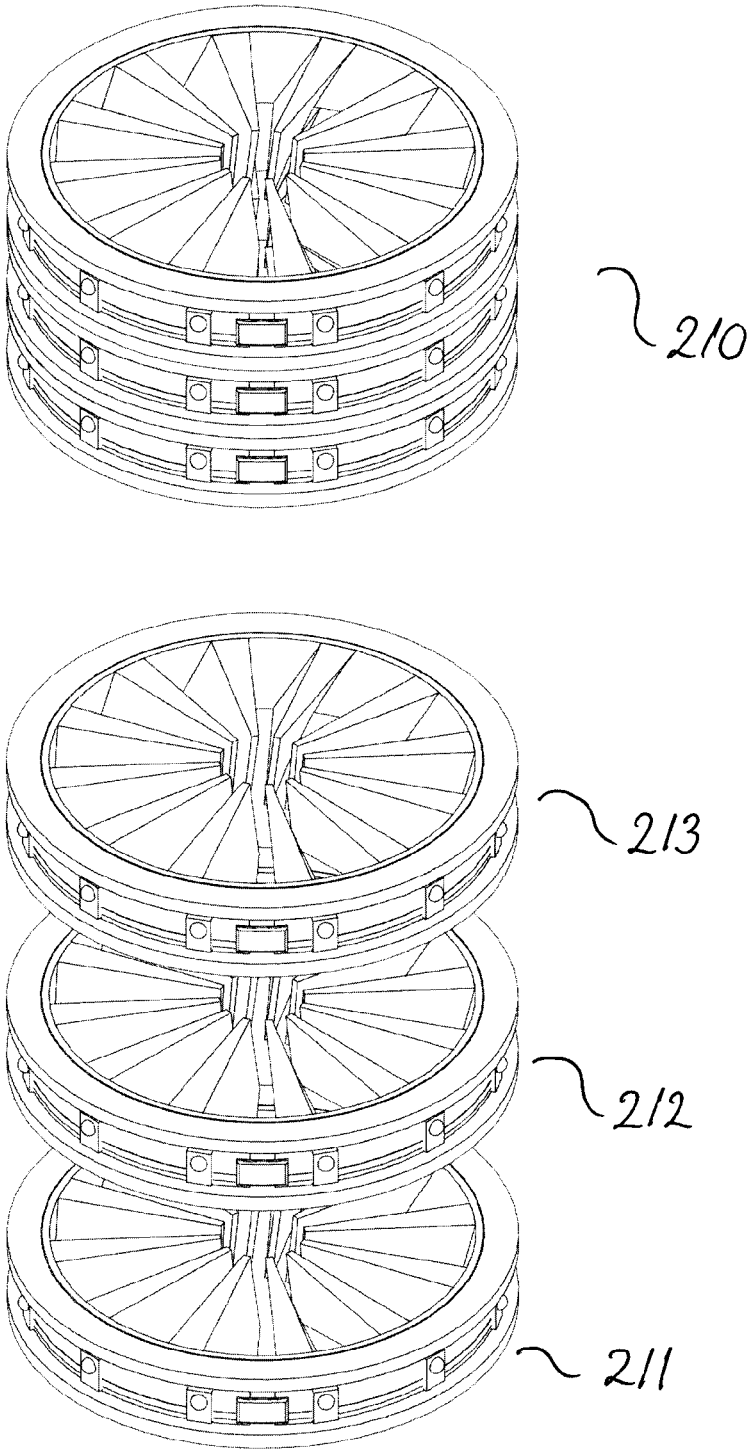
FIG. 2*c* shows a stacked LED lamp assembly holding three of the LED assemblies shown in FIG. 1*b*, FIGS. 3*a* and 3*b* are diagrams illustrating examples of surface-mount LEDs, which may be used in the assemblies of FIGS. 1*a* and 1*b*, FIGS. 4*a*-4*d* illustrate electrical connections and mounting of the LEDs of the assembly of FIG. 1*a*, FIGS. 4*e* and 4*f* illustrate electrical connections and mounting of the LEDs of the assembly of FIG. 1*b*.

FIG. 2*c* shows a stacked LED lamp assembly 210 holding three of the LED assemblies 200 shown in FIG. 1*b*. The three LED assemblies 211, 212, and 213 are stacked so that the cooling fins 207 are aligned, whereby the top surface of a cooling fin 207 of assembly 211 is aligned with the bottom surface of a cooling fin 207 of assembly 212, and the top surface of a cooling fin 207 of assembly 212 is aligned with the bottom surface of a cooling fin 207 of assembly 213.

Figure 3A:
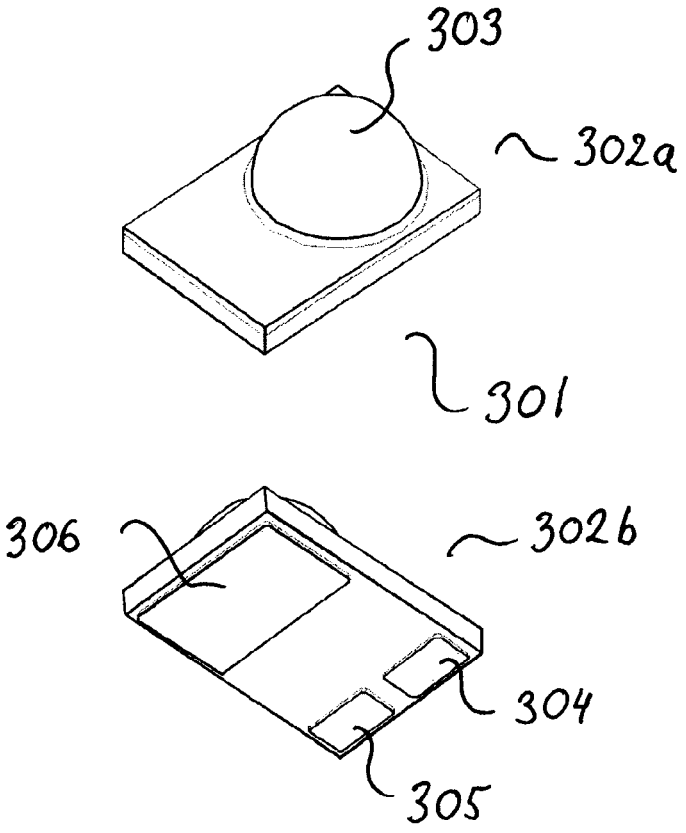
Figure 3B:
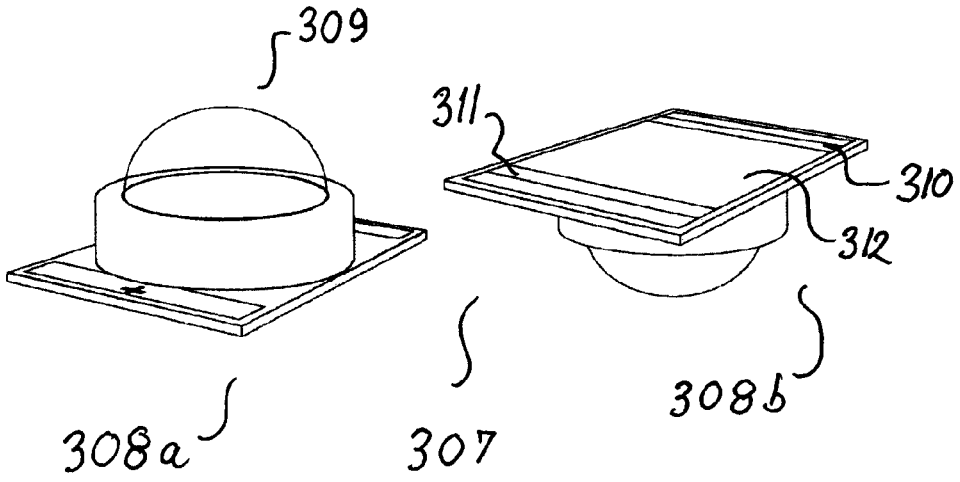

FIGS. 3*a* and 3*b* are diagrams illustrating examples of surface-mount LEDs, which may be used in the assemblies of FIGS. 1*a* and 1*b*. The LED 301 of FIG. 3*a* is a LUXEON® Rebel type compact, surface-mount, high power LED. 302*a* shows the LED 301 from the front side, and 302*b* shows the LED 301 from the back side. The diode part 303 is arranged on the front side 302*a*, and on the back side 302*b*, the LED 301 has a cathode pad 304, an anode pad 305, and a thermal pad 306, where the thermal pad 306 is electrically isolated from the cathode and anode contact pads 304, 305. When LEDs 301, 103 are arranged in the grooves 104 of the heat sink 101, the thermal pads 306 are thermally contacting or mounted to the outer circumference part 102 of the heat sink 101.

The LED 307 of FIG. 3*b* is Cree® XLamp® XR-E type LED. 308*a* shows the LED 307 from the front side, and 308*b* shows the LED 307 from the back side. The diode part 309 is arranged on the front side 308*a*, and on the back side 308*b*, the LED 307 has a cathode pad 310, an anode pad 311, and a thermal pad 312, where the thermal pad 312 is electrically isolated from the cathode and anode contact pads 310, 311.

For the assemblies 100, 200 of FIGS. 1*a* and 1*b*, the heat sink 101, 201 could also be made of an electrically conductive material, such as aluminium. In this case, the LEDs may be mounted on a printed circuit board, such as a flexible printed circuit board, which is then mounted to the outer circumference part 102, 202 of the heat sink 101, 102.

Figure 4A:
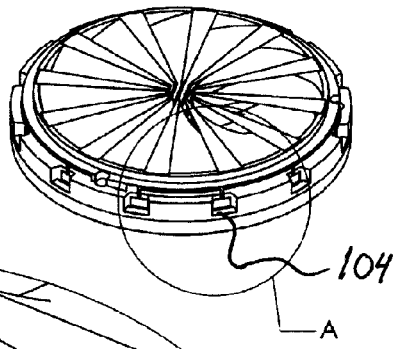
Figure 4B:
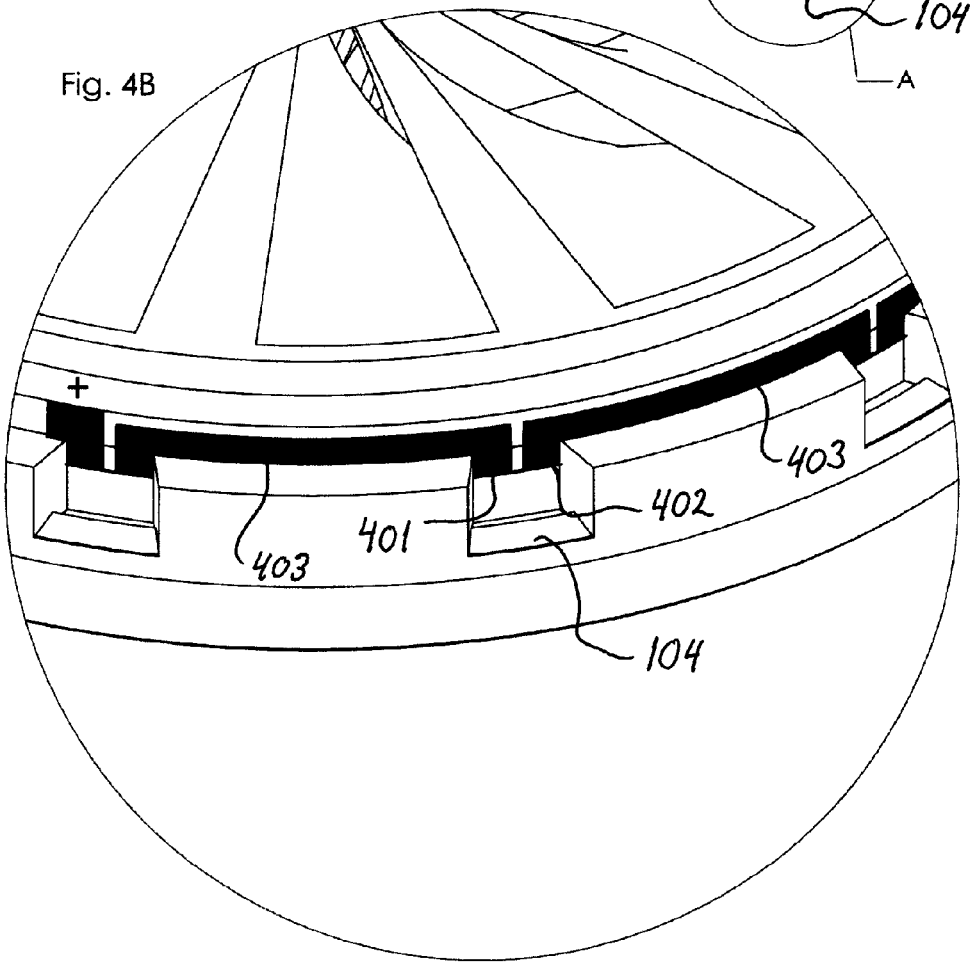

FIGS. 4*a*-4*d* illustrate an example of electrical connections and mounting of the LEDs 103 of the assembly 100 of FIG. 1*a*. FIGS. 4*a* and 4*b* show the electrical connections for the assembly of FIG. 1*a* when using LEDs of the type 301 of FIG. 3*b*, where FIG. 4*b* is an enlarged drawing. For each groove 104 there is an electrical connection 401 for the anode 305, and an electrical connection 402 for the cathode 304. The groove 104 is formed so to fit with the thermal pad 306. The LEDs 103 may be divided into a number of groups with the LEDs 103 of the same group being electrically connected in series, with each group of series connected LEDs 103 have first and second voltage inputs. The groups of series connected LEDs 103 may be connected in parallel, where the first voltage inputs are connected to ground or minus of the supply voltage and the second voltage inputs are connected to plus of the supply voltage. However, in another embodiment all the LEDs 103 may be connected in series.

For the assembly shown in FIGS. 4*a*-4*d*, the heat sink 101 including both the outer circumference part 102 and the cooling fins 107 is made of a non-conducting material such as aluminium nitride, AlN. In order to serially connect the LEDs 103, metallization tracks 403 are provided at the outer circumference part 102 of the heat sink 101 for connecting the anode 401 of a first LED 103 to the cathode 402 of the next LED 103. For a group of series connected LEDs 103 the first voltage inputs of the groups of LEDs 103 may be electrically conductive connected to the conducting plate or ring 106, and the second voltage inputs of the groups of LEDs 103 may be electrically connected to corresponding contact plugs arranged at the outer circumference part 102 of the heat sink 101.

Figure 4C:
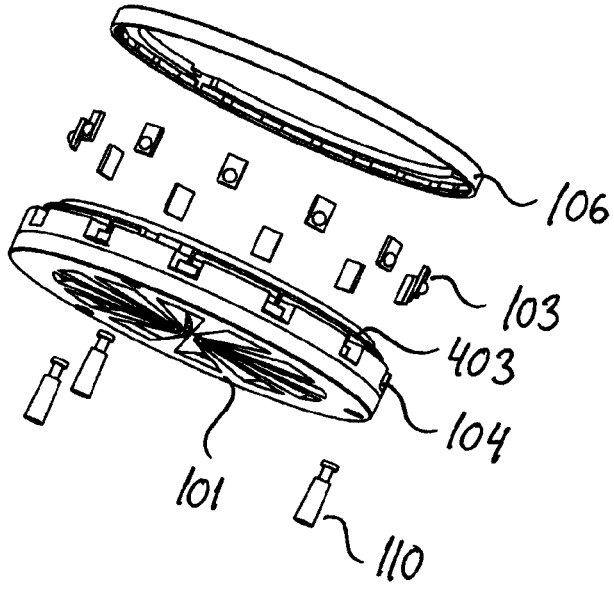
Figure 4D:
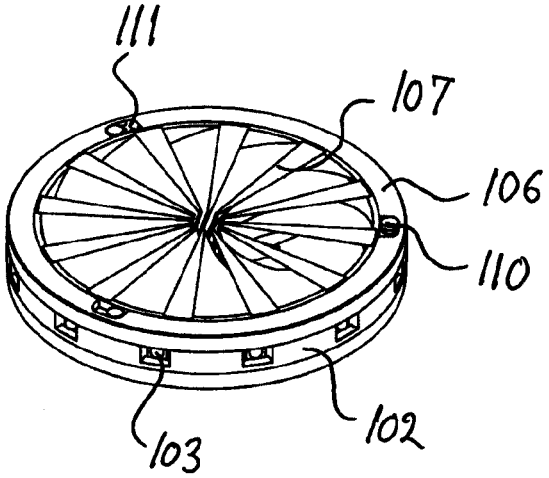

FIGS. 4*c*-4*d* show the mounting of the LEDs 103 of the assembly 100 of FIG. 1*a*, where FIG. 4*d* is similar to FIG. 1*a*. The three conic pins 110 are used to keep the main body of the heat sink 101 and the top-ring 106 together via a bayonet-grip with the top-ring 106. The conic pins 110 are inserted into the openings 111 of the top ring 106, where the openings 111 are made large enough to make room for contact plugs 604 for a second voltage input to a corresponding group of LEDs 103.

Figure 4E:
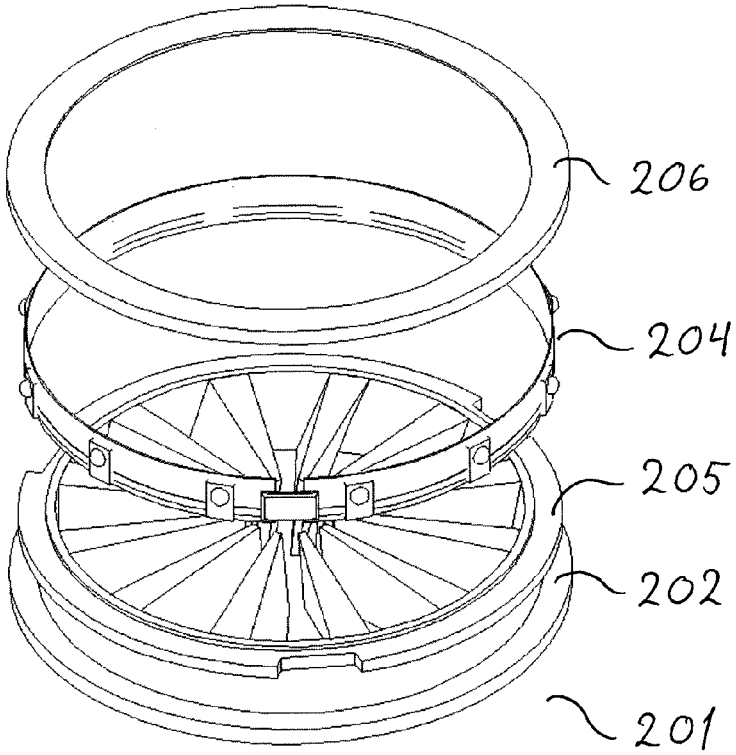
Figure 4F:
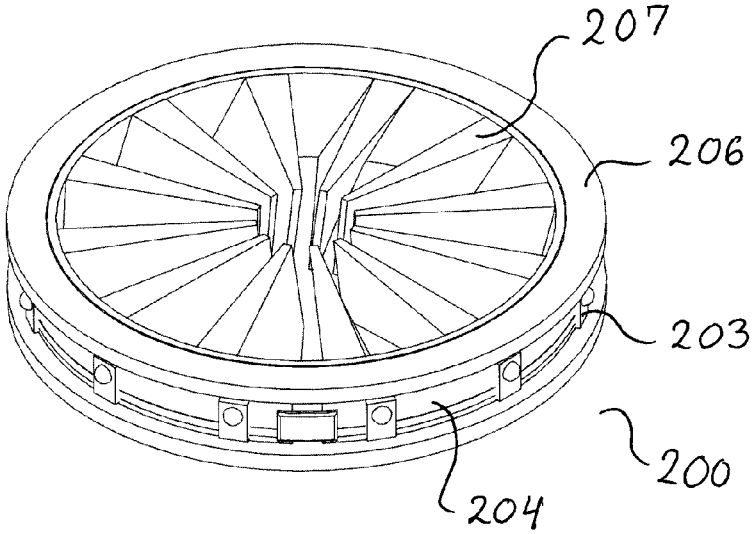

FIGS. 4*e* and 4*f* illustrate electrical connections and mounting of the LEDs 203 of the assembly 200 of FIG. 1*b*, where FIG. 4*f* is similar to FIG. 1*b*. FIG. 4*e* shows the flexible printed circuit board 204 with the LEDs 203 mounted thereon. The LEDs 203 are electrically connected in series by the printed circuit board 204. FIG. 4*e* shows the heat sink 201, the flexible printed circuit board 204 and the top ring 206 before being assembled. The circuit board 204 is arranged in the groove in the outer circumference part 202, and the top-ring 206 is arranged at the top groove 205 to thereby lock the circuit board 204 holding the LEDs 203.

Figure 5:
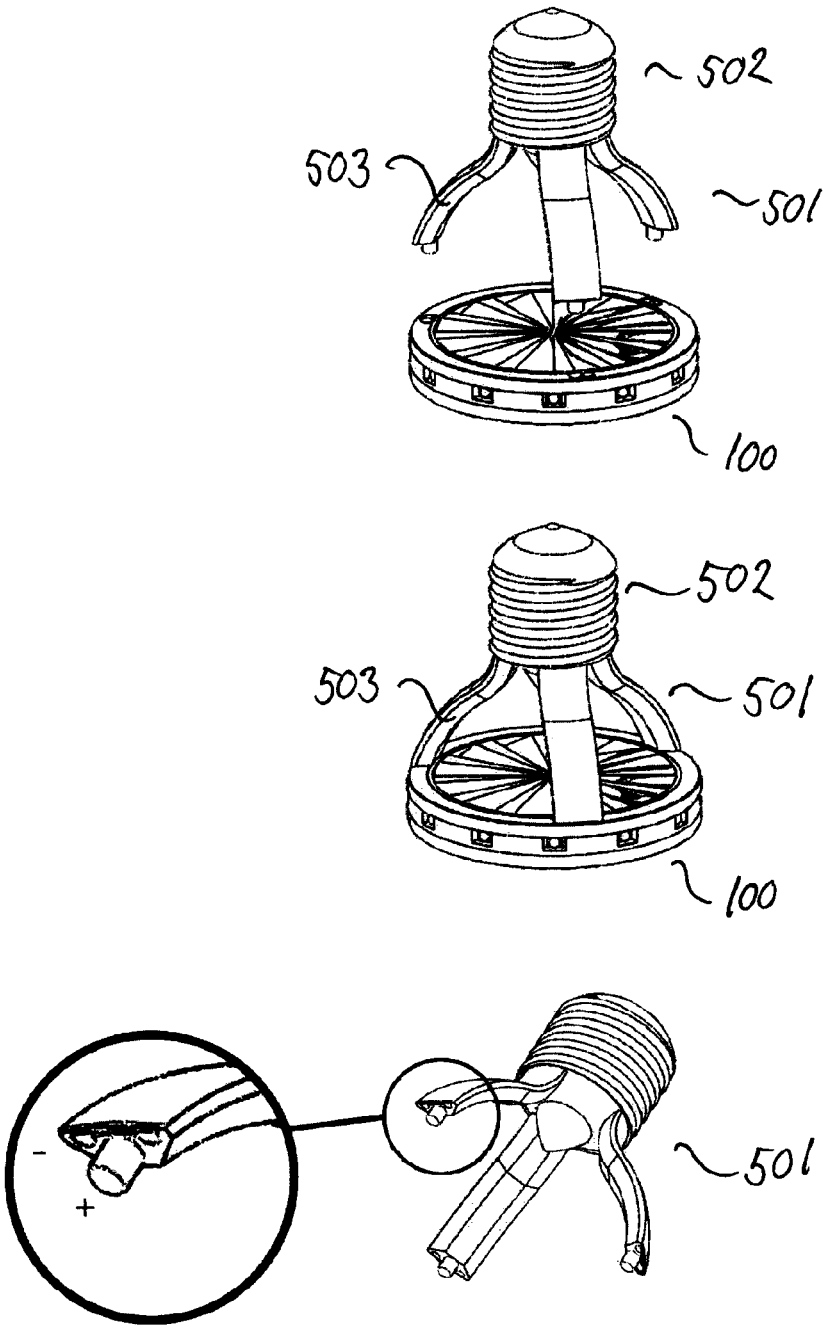
FIG. 5 shows a LED lamp assembly according to an embodiment of the invention, wherein the assembly of FIG. 1*a* further holds a base with a retrofit adaptor.

FIG. 5 shows a LED lamp assembly according to an embodiment of the invention, wherein the assembly 100 of FIG. 1*a* further holds a base 501 with a retrofit adaptor 502. The base 501 is adapted for holding the heat sink 101 and for providing supply of electrical power to the LEDs 103. The base 501 is attached to the assembly 100 via three legs 503 and three plugs 504, through which legs 503 and plugs 504 power is supplied to the LEDs 103. When having groups of series connected LEDs 103 power is supplied to the second voltage inputs of the groups of LEDs 103. The plugs 504 fits into the opening 111 of the top ting 106. For the embodiment illustrated in FIG. 5, there are three base-legs 503 and there may be three corresponding groups of series connected LEDs 103. The base 501 shown in FIG. 5 has a retrofit adaptor 502 being compatible with Edison type sockets. The adaptor 502 of the base 501 holds driver circuitry for supplying a DC voltage to the LEDs 103, where the driver circuitry comprises an AC to DC converter for converting a high-voltage AC input into a DC output for supplying the LEDs. The base 501 may also be used for the LED lamp assembly 200 of FIG. 1*b*.

Figure 6A:
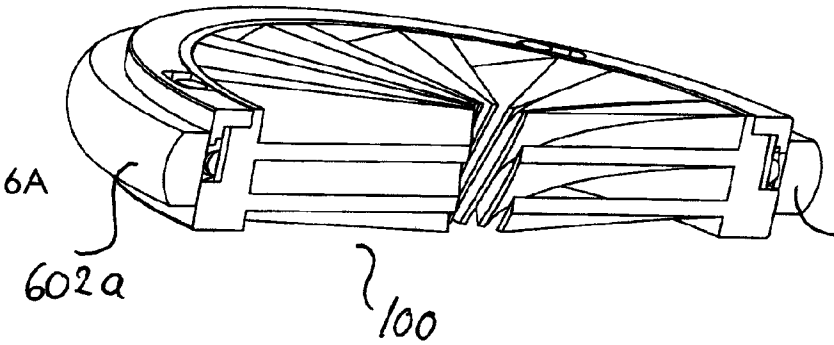
FIGS. 6*a*-6*c* shows LED lamp assemblies according to embodiments of the invention, wherein the assembly of FIG. 1*a* further holds a lens for spreading the light from the LEDs.
Figure 6B:
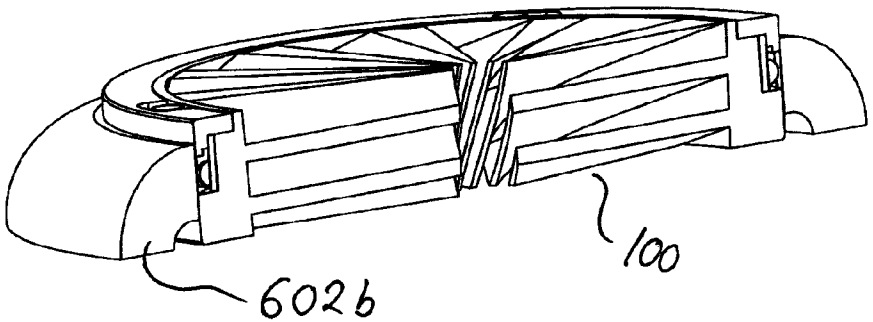
Figure 6C:
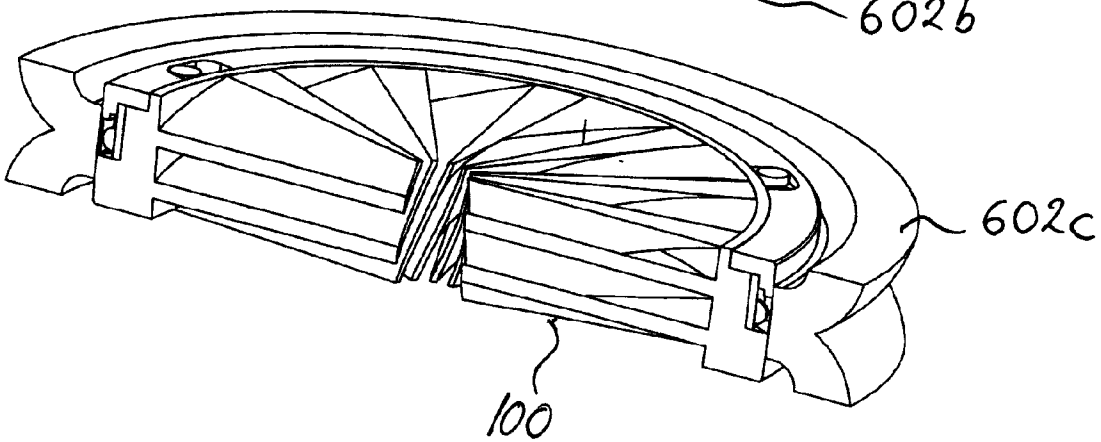

FIGS. 6*a*-6*c* shows LED lamp assemblies 100 according to embodiments of the invention, wherein the assembly 100 of FIG. 1*a* further holds a lens or lenses 601 for spreading the light from the LEDs 103. The lens or lenses 601 may be shaped as a ring and in different designs depending on which light direction is needed from the lamp assembly. The lens or lenses 601 may be an optical fiber ring or rings, and it is preferred to use transparent Silicone, which may have a high internal reflection. The lens or lenses 601 should be designed to fit the outer diameter of the heat sink 101 and be shaped for directing the light from the LEDS 103 into a wanted direction. The lens or lenses 601 may be mounted like a rubber band that can be expanded and placed round the heat sink 101.

Thus, the lenses or a lens 601 may be arranged in front of at least part of the LEDs 103, which are supported by the outer circumference of the heat sink 101, and the lens/lenses 601 may cover the LEDs 102 being supported by the outer circumference of the heat sink 101, and the lens/lenses 601 may be made in one piece.

It is preferred that for each LED 103 a corresponding outwardly pointing convex part 701 is formed on the inner surface part 702 of the lens/lenses 601 facing the LED 103. This is further illustrated in FIG. 7, which is a detailed view of the lens of FIG. 6*a* showing the outwardly convex parts 701 of the lens 601. The convex parts 701 may be partially cylindrically formed. By using such convex formed parts 701 in the lens 601, the light emitted from the corresponding LED 103, may be collected to be more parallel than when emitted from the LED 103.

It is preferred that overall design of the lens 601 is made so as to spread out the diode light at an angle being wider than the light emission angle of the LEDs 103 or the viewing angle of the LEDs 103.

Figure 7:
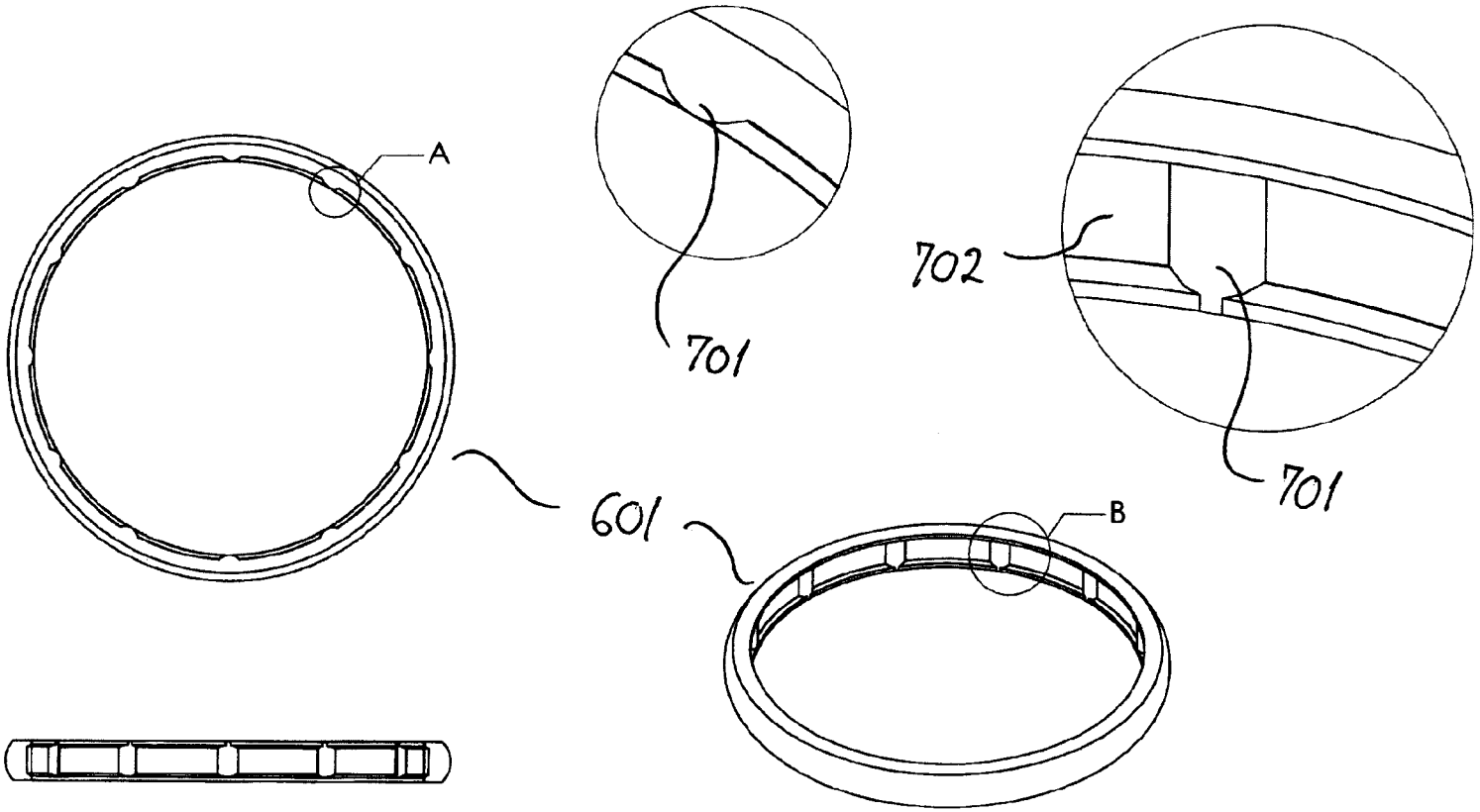
FIG. 7 is a detailed view of the lens of FIG. 6*a* showing outwardly convex parts of the lens.

For the assembly of FIG. 6*a* and for the lens of FIG. 7, the outer surface 602*a* of the lens/lenses 601 lens/lenses is formed so as to spread out the diode light at a wide angle in a main direction equal to the main direction of the light received from the LEDs 103. The outer surface 602*b* of the lens/lenses 601 may also be formed so as to spread out the diode light in a main direction being at an angle relative to the main direction of the light received from the LEDs 103, which is illustrated by the assembly of FIG. 6*b*, where the outer surface 602*b* of lens/lenses 601 is formed so as to spread out the diode light in a main direction being substantially perpendicular to the main direction of the light received from the LEDs 103. The present invention also covers an assembly, wherein the outer surface 602*c* of the lens/lenses 601 is formed so as to spread out the diode light in at least two different main directions as illustrated by the assembly of FIG. 6*c*. In FIG. 6*c* the outer surface 602*c* of the lens 601 is formed so as to spread out the diode light in two substantially opposite main directions being substantially perpendicular to the main direction of the light received from the LEDs.

It should be understood that the present invention also covers LED lamp assemblies, wherein the assembly 200 of FIG. 1*a* further holds a lens or lenses, which may be a lens as described in connection with FIGS. 6*a*-6*c* and FIG. 7.

Figure 8:
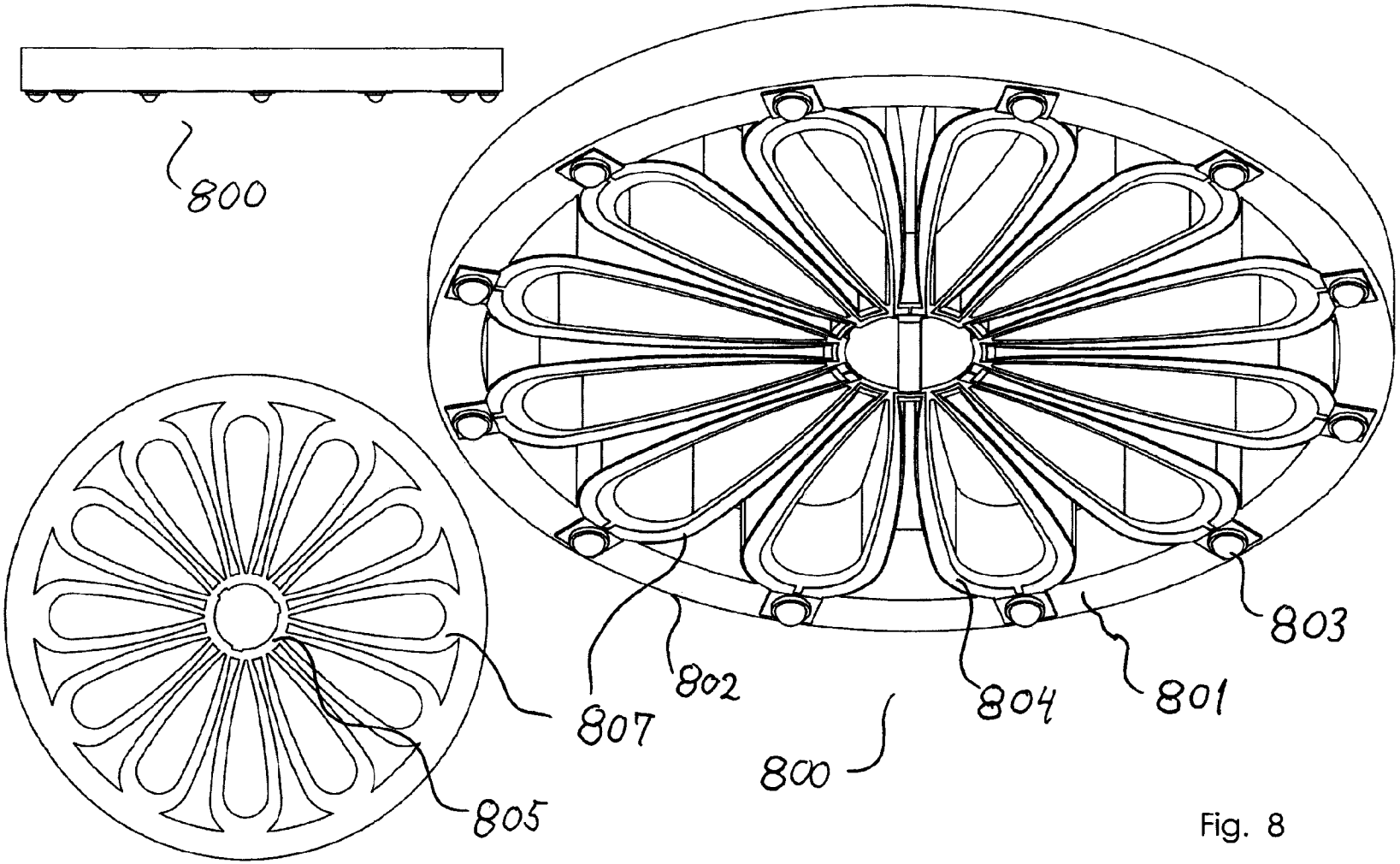
FIG. 8 shows a LED lamp assembly according to a second embodiment of the invention, wherein the assembly holds a heat sink mounted with LEDs.
Figure 9:
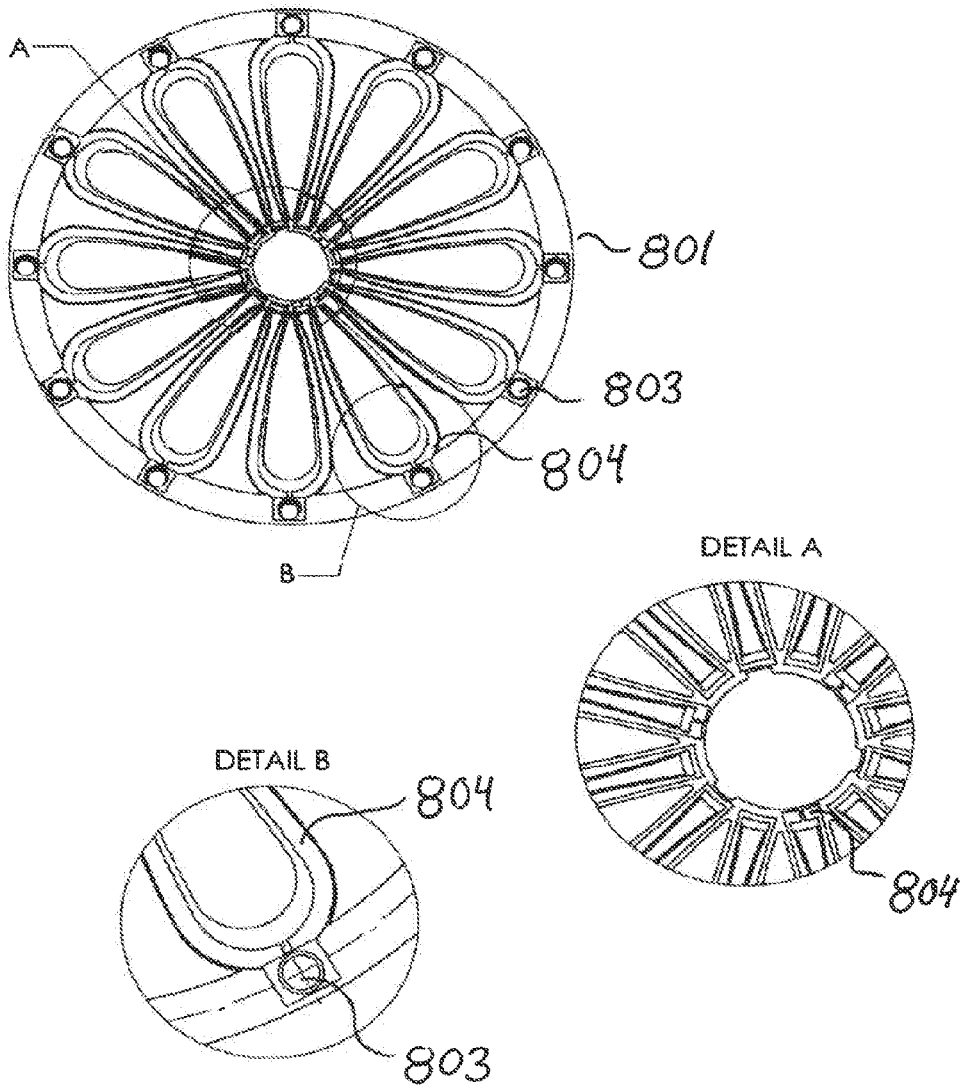
FIG. 9 is a detailed view of the assembly of FIG. 8 showing thick film connector prints at the heat sink.

FIG. 8 shows a LED lamp assembly 800 according to a second embodiment of the invention, wherein the assembly holds a heat sink 801 mounted with LEDs 803. The heat sink is made of an electrically non-conductive material, such as a ceramic material, and thick film conductors 804 may be printed directly on the heat sink for supplying power to the LEDs 803. FIG. 9 is a detailed view of the assembly of FIG. 8 showing thick film connector prints 804 at the heat sink 801. The thick film conductors 804 may be printed directly on non-conductive parts 803 of the heat sink 801 and connected to cathode and anode pads of the surface-mount LEDs 803 for supplying power to the LEDs 803. It is preferred that the LEDs 803 are surface-mount LEDs, which may be of the type shown in FIG. 3*b*, and which on the back side have a cathode pad, an anode pad and thermal pad, and wherein the thermal pads are thermally contacting or mounted to the heat sink 801.

The surface-mount LEDs 803 may be divided into a number of groups with the LEDs of the same group being electrically connected in series with the printed thick film conductors electrically connecting the LEDs 803.

For the assembly 800 of FIGS. 8 and 9, the heat sink 801 comprises a ring-shaped outer circumference 802 supporting the cooling fins 807 and the LEDs 803 and a centre part 805 also supporting the cooling fins 807. The thick film conductors 804 are printed along the cooling fins 807 allowing a voltage supply to the LEDs 803.

Figure 10A:
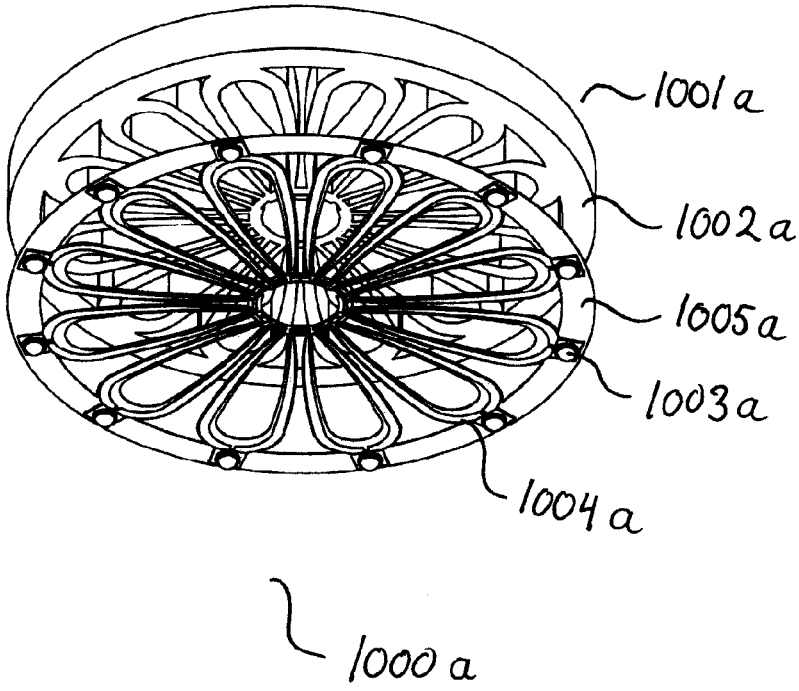
FIGS. 10*a* and 10*b* show LED lamp assemblies according to a third embodiment of the invention, wherein the assembly holds a heat sink mounted with LEDs and wherein an insulating layer is provided between the heat sink and conductors supplying power to the LEDs.
Figure 10B:
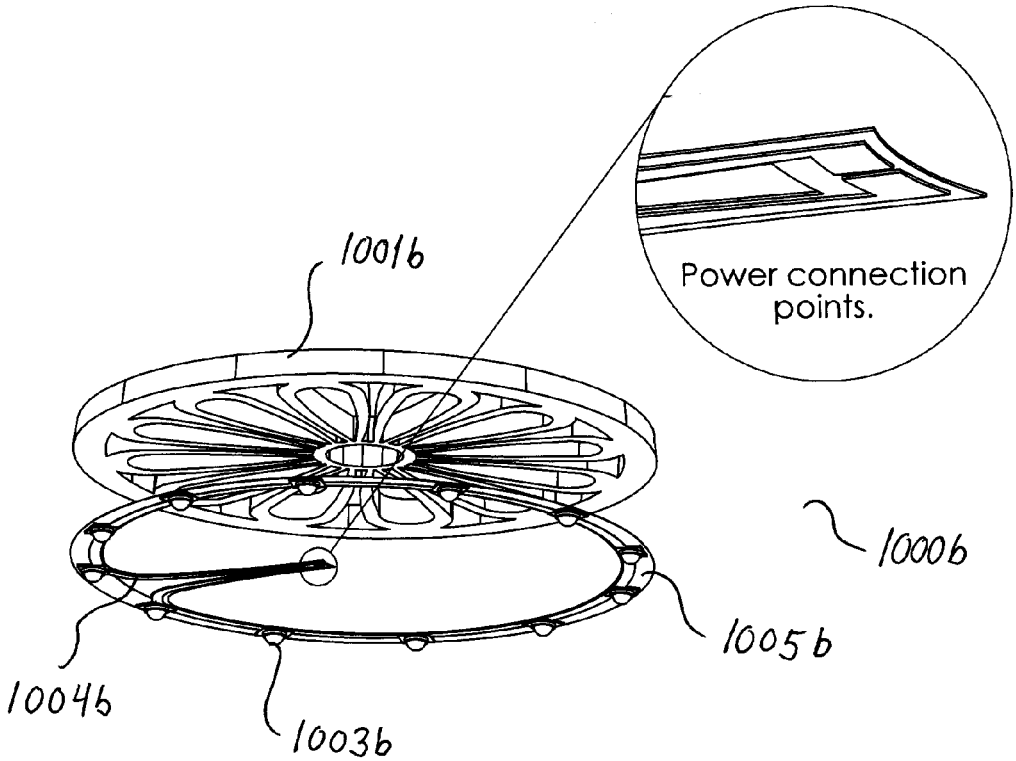

FIGS. 10*a* and 10*b* show LED lamp assemblies 1000*a*, 1000*b* according to a third embodiment of the invention, wherein the assemblies 1000*a*, 1000*b* hold a heat sink 1001*a*, 1001*b* mounted with LEDs 1003*a*, 1003*b* and wherein an insulating layer 1005*a*, 1005*b* is provided between the heat sink 1001*a*, 1001*b* and conductors 1004*a*, 1004*b* supplying power to the LEDs 1003*a*, 1003*b*. The heat sink 1001*a*, 1001*b* may be made of an electrically conductive material, such as aluminium.

FIGS. 11*a*-*c* illustrate a LED lamp assembly 1100 according to a fourth embodiment of the invention. The assembly 1100 holds a heat sink 1101 with a ring shaped outer circumference 1102 for holding the LEDs (not shown). The heat sink 1101 further has a cooling structure 1107 with vent-holes 1108 to allow passage of air. FIG. 11*a* is a side/top view of the assembly 1100, showing that the heat sink 1101 with the cooling structure 1107 has the form of a bowl. However, the heat sink 1101 could also be flat. The size of the vent-holes 1108 decreases inwards towards the centre 1109, but it is preferred that the size of the vent-holes 1108 is dimensioned so that the area taken up by the vent-holes 1108 relative to the area of the rigid cooling part surrounding the vent-holes 1108 increases inwards from the outer circumference part to 1102 the centre 1109 of the heat sink 1101.

FIG. 11*b* is a side/bottom view of the assembly 1100, and FIG. 11*c* is a detailed view illustrating the arrangement of electrical conductors 1104, 1105 for supplying power to the LEDs, and further showing a solder pad 1106 for soldering the thermal pad of the LED to the outer circumference part 1102 of the heat sink. The heat sink may be made of an electrically non-conductive material, such as a ceramic material, and thick film conductors 1104, 1105 may be printed directly on the heat sink 1107, 1102 for supplying power to the LEDs. The LEDs are surface-mount LEDs, which may be of the type shown in FIG. 3*b*, and which on the back side have a cathode pad, an anode pad and thermal pad, and wherein the thermal pads may be thermally contacting or mounted to the heat sink 1101 via soldering 1106.

Figure 12A:
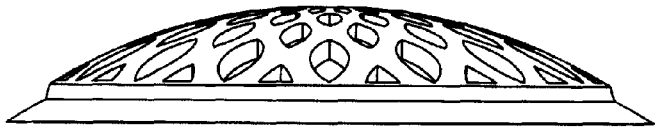
FIGS. 12*a-d* illustrate a side view, a cut-through view and a bottom view of the LED lamp assembly of FIGS. 11*a-c,*
Figure 12B:
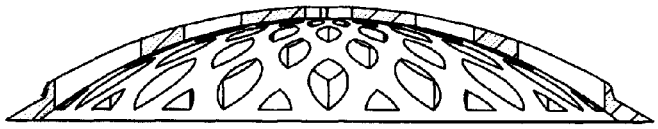
Figure 12C:
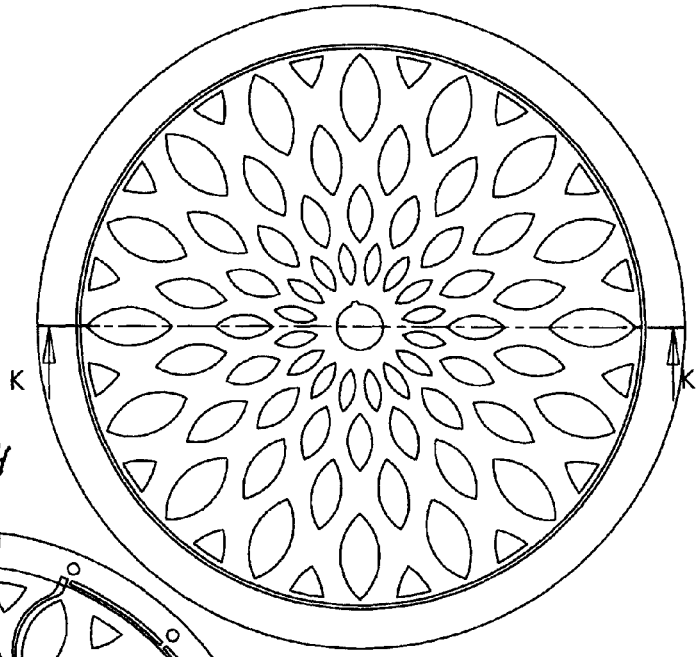
Figure 12D:
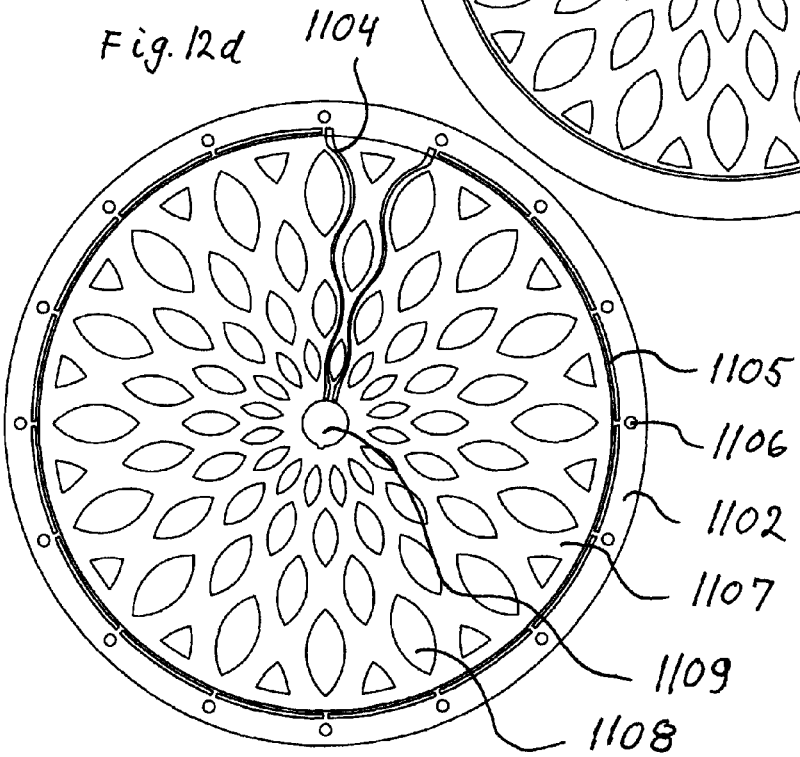

FIGS. 12*a* is a side view, FIG. 12*b* is a cut-through view, where FIG. 12*c* shows the cut-through line, and FIG. 12*d* is a bottom view of the LED lamp assembly 1100 of FIG. 11. FIG. 12*b* shows that the material thickness of the cooling structure 1107 decreases inwards from the outer circumference part 1102 to the centre 1109 of the heat sink 1101.

In order to obtain a desired amount of light from an assembly according to the present invention, the LEDs 103, 803, 1003 may be arranged at the outer circumference of the heat sink 101, 801, 1001 with a nearest neighbour distance in the range of 1-3 cm, such as in the range of 1.5-2 cm.

For the assemblies illustrated in FIGS. 1*a*, 1*b*, the LEDs 103, 203 supported by the outer circumference 102, 202 of the heat sink 101, 201 are arranged so that the main direction of the emitted light is perpendicular to a centre axis of the heat sink 101, 201, while for the assemblies illustrated in FIGS. 8, 9, 10*a*, 10*b*, the LEDs 803, 1003*a*, 1003*b* supported by the outer circumference 802, 1002*a*, 1002*b* of the heat sink is arranged so that the main direction of the emitted light is parallel to a centre axis of the heat sink. It should however be understood that the present invention also covers assemblies, wherein the LEDs supported by the outer circumference of the heat sink is arranged so that the main direction of the emitted light is tilted when compared to a centre axis of the heat sink.

For the LED lamp assemblies described in connection with FIGS. 1-12, the light emitting sources, the LEDs, are arranged on or supported by the outer circumference part of the heat sink. For the lamp assemblies of FIGS. 1, 2, 11, and 12, it is preferred that the heat sinks are designed so that the material thickness of the rigid cooling part or parts of a heat sink decreases inwards from the outer circumference part, where the LEDs may be arranged, towards the centre of the heat sink. It is further preferred that this decrease in material thickness is a continuous decrease. However, the present invention also covers embodiments, wherein the one or more light emitting sources are arranged at or around the centre of the heat sink.

Such embodiments are described in connection with the lamp assemblies of FIGS. 13-17. Here, the light emitting source may be an arrangement of LEDs, such a for example the PrevaLED® Core light engines from OSRAM, see FIGS. 18*a* and *b*. The PrevaLED® Core light engines come with different numbers of LEDs and thereby with different light intensities, such as from 800-300 lumen. They may all have the same outer diameter about 48 mm, and the LEDs are arranged at the centre within a circle having a diameter of about 16-21 mm.

Figure 13A:
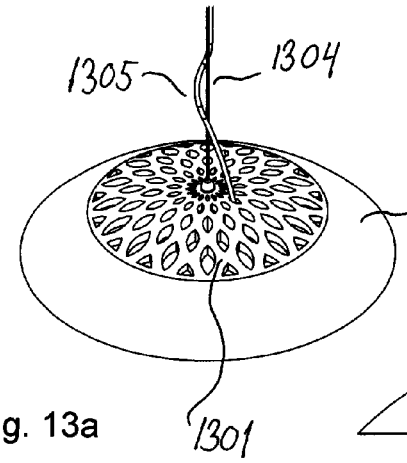
FIGS. 13*a-e* illustrate a lamp assembly according to a fifth embodiment of the invention, wherein the heat sink comprises a cooling structure with vent-holes.
Figure 13B:
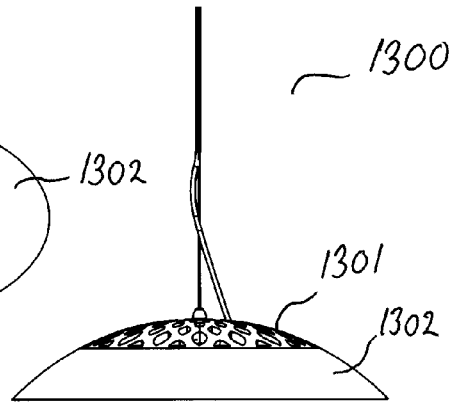
Figure 13C:
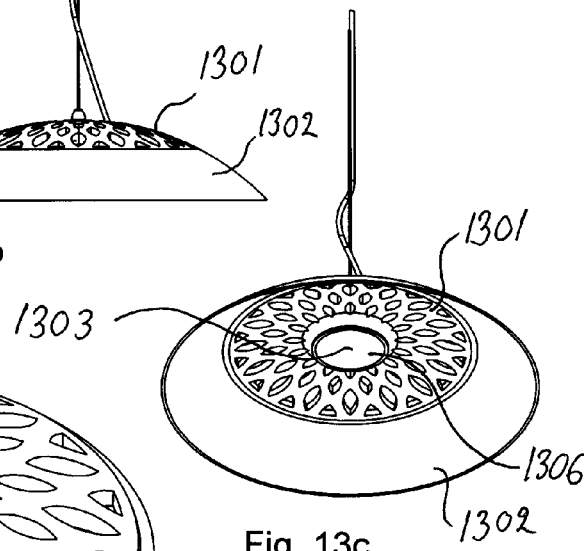
Figure 13D:
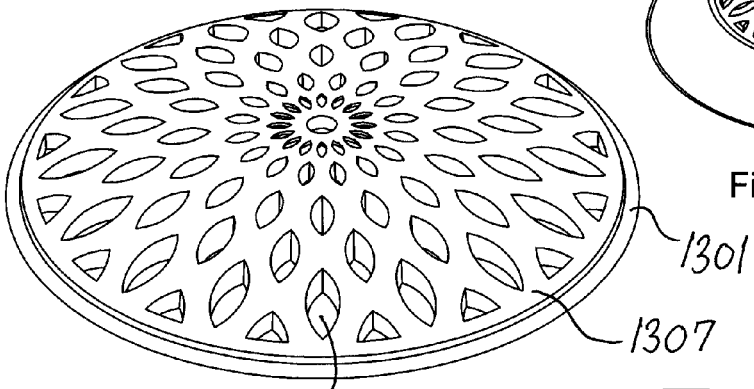
Figure 13E:
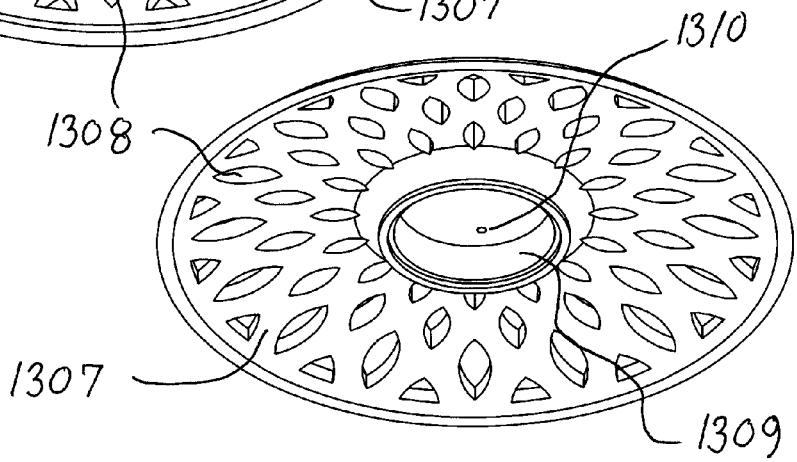

FIGS. 13*a-e* illustrate a lamp assembly 1300 according to a fifth embodiment of the invention, which may be used together with LED light source, such as a PrevaLED® Core light engine, and wherein the heat sink 1301 comprises a cooling structure with vent-holes 1308. FIGS. 13*a, b* and *c* are a top view, a side view, and a bottom view of the lamp 1300, respectively, showing the heat sink 1301 with a lampshade 1302 around the heat sink 1301. The lamp 1300 is supported by a wire 1304 and an electrical supply wire 1305 goes through a hole 1310 in the heat sink and reaches the light source/engine 1303 arranged at the bottom side of the heat sink 1301. It is preferred that a diffuser or diffuser plate 1306 is arranged below the light source/engine 1303. FIG. 13*d* is a top view of the heat sink 1301 and FIG. 13*e* is a bottom view of the heat sink 1301. The heat sink 1301 has a ring shaped outer circumference, and comprises a cooling structure 1307 with vent-holes 1308 to allow passage of air. A recess 1309 is provided at the centre and at the bottom of the heat sink 1301. The recess 1309 is dimensioned to fit a light source/engine 1303, such as a PrevaLED® Core light engine, and the recess may have a groove for holding a diffuser 1306.

FIGS. 14*a-c* illustrate a side view, a cut-through view and a top view, respectively, of the heat sink 1301 of the lamp assembly 1300 of FIGS. 13*a-e*, where FIG. 14*c* shows the cut-through line, E-E. As may be seen from FIG. 14*c*, the size of the vent-holes 1308 may decrease inwards towards the centre, and it is preferred that the size of the vent-holes 1308 is dimensioned so that the area taken up by the vent-holes 1308 relative to the area of the rigid cooling part surrounding the vent-holes 1308 increases inwards from the outer circumference part to the centre of the heat sink 1301. The cut through view in FIG. 14*b* shows the recess 1309 provided for the light source/engine 1303. It is also seen from FIG. 14*b* that there are no through going vent holes 1308 at the centre part 1311 of the heat sink 1301, where the centre part 1311 holds the recess 1309, which again may hold the light source/engine 1303. It is also seen from FIG. 14*b* that the material thickness of the cooling structure 1307 increases inwards from the outer circumference part towards the centre part 1311, where the light source/engine may be arranged. The upper surface of the heat sink 1301 may have the form of an inverted bowl. The heat sink 1301 may be made of an electrically non-conductive material, such as a ceramic material. It is preferred that through going vent-holes 1308 has a size of no less than 0.5 $cm^2$ and a length not smaller than 0.7 cm.

FIGS. 15*a-e* illustrate a lamp assembly 1500 according to a sixth embodiment of the invention, which may be used together with LED light source, such as a PrevaLED® Core light engine, and wherein the heat sink 1501 has a folded cooling structure. FIG. 15*a* is a top view of the lamp 1500, while FIG. 15*b* is a bottom view of the lamp. The lamp assembly 1500 is mainly made up of the heat sink 1501, and supported by a wire 1504 with an electrical supply wire 1505 going through a hole 1510 in the heat sink 1501 to reach the light source/engine at the bottom side of the heat sink 1501. FIGS. 15*c-e* illustrate a side view, a cut through view, and a top view, respectively, of the heat sink 1501. The heat sink 1501 has a folded or pleat like cooling structure and no vent-holes. The bottom view of FIG. 15*b* and the cut through view of FIG. 15*d* shows a recess 1509 provided for the light source/engine. Also here a groove may be provided at the recess 1509 for holding a diffuser below the light source/engine. It may also be seen from FIG. 15*d* that the material thickness of the cooling heat sink 1501 increases inwards from the outer circumference part towards the centre part 1511, where the light source/engine may be arranged. Thus the volume or relative volume taken up by the rigid cooling part of the heat sink 1501 increases inwards from the outer circumference part towards the centre part 1511. The folded shape of the heat sink 1501 creates a larger cooling surface when compared to a conventional disc shape of the same diameter. The heat sink 1501 may have the form of an inverted bowl. The heat sink 1501 may be made of an electrically non-conductive material, such as a ceramic material.

Figure 16A:
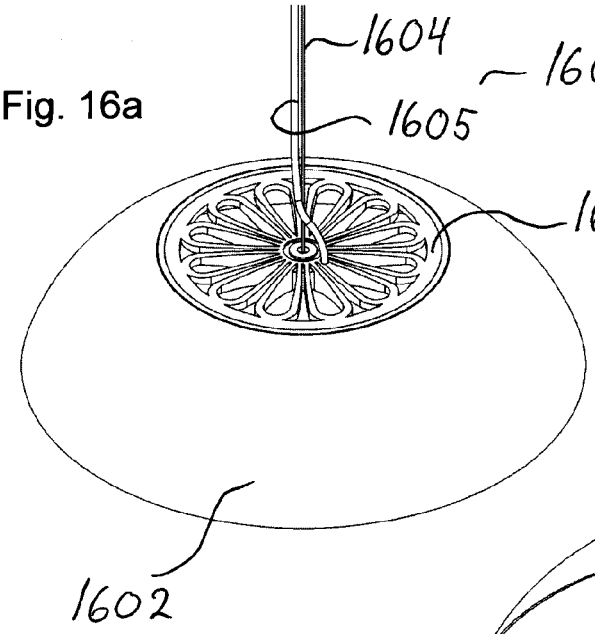
FIGS. 16*a-d* illustrate a lamp assembly according to a seventh embodiment of the invention, wherein the heat sink comprises a cooling structure with vent-holes.
Figure 16B:
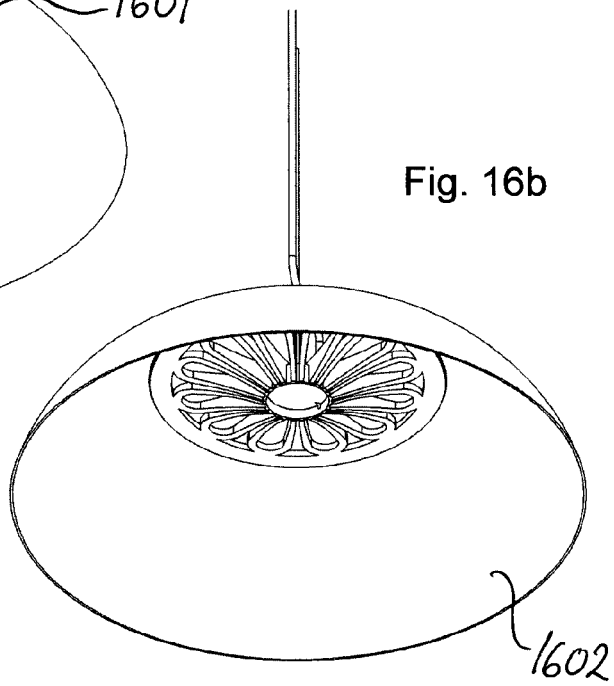
Figure 16C:
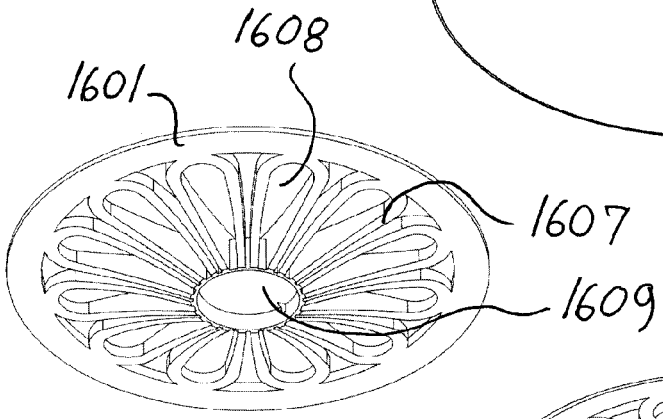
Figure 16D:
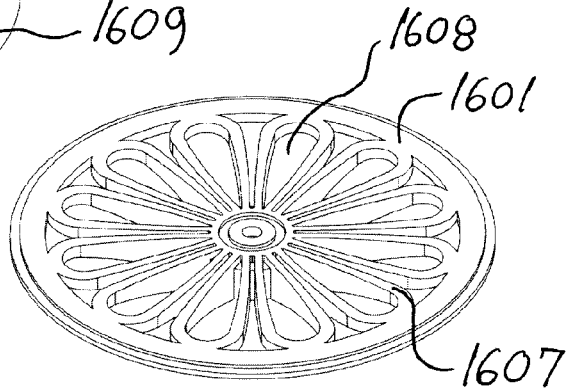

FIGS. 16*a-d* illustrate a lamp assembly 1600 according to a seventh embodiment of the invention, which may be used together with LED light source, such as a PrevaLED® Core light engine, and wherein the heat sink 1601 comprises a cooling structure with vent-holes or openings 1608. FIGS. 16*a* and *b* are a top view and a bottom view of the lamp 1600, respectively, showing the heat sink 1601 with a lampshade 1602 around the heat sink 1601. The lamp 1600 is supported by a wire 1604 and an electrical supply wire 1605 goes through the heat sink 1601 and reaches the light source/engine, which may be arranged at the bottom side of the heat sink 1601. Also here a diffuser or diffuser plate may be arranged below the light source/engine. FIG. 16*c* is a top view of the heat sink 1601 and FIG. 16*d* is a bottom view of the heat sink 1601. The heat sink 1601 has a ring shaped outer circumference, and comprises a cooling structure 1607 with oblong vent-openings 1608 to allow passage of air. A recess 1609 is provided at the centre and at the bottom of the heat sink 1601. The recess 1609 is dimensioned to fit a LED light source/engine, such as a PrevaLED® Core light engine, and the recess may have a groove for holding a diffuser below the light source.

FIGS. 17*a-c* illustrate a side view, a cut-through view and a bottom view, respectively, of the heat sink 1601 of the lamp assembly 1600 of FIGS. 16*a-d*, where FIG. 17*c* shows the cut-through line, G-G. The cut through view in FIG. 17*b* shows the recess 1609 provided for the light source/engine. It is also seen from FIG. 17*b* that there are no through going vent-openings 1608 at the centre part 1611 of the heat sink 1601, where the centre part 1611 holds the recess 1609, which again may hold the light source/engine. It is also seen from FIGS. 17*a* and 17*b* that the material thickness of the cooling structure 1607 increases inwards from the outer circumference part towards the centre part 1611, where the light source/engine may be arranged. The upper surface of the heat sink

1601 may be flat. The heat sink 1601 may be made of an electrically non-conductive material, such as a ceramic material.

For the lamp assemblies or heat sinks of FIGS. 13-17, it is preferred that the heat sinks are designed so that the material thickness of the rigid cooling part or parts of a heat sink increases inwards from the outer circumference part towards the centre of the heat sink, where the LED light source may be arranged. It is further preferred that this increase in material thickness is a continuous increase.

Figure 18A:
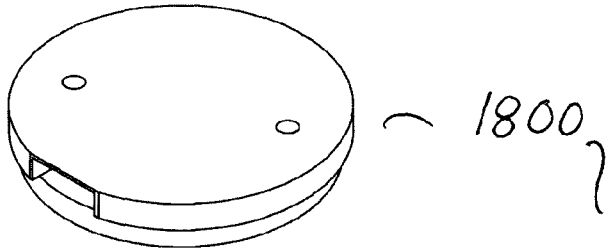
Figure 18B:
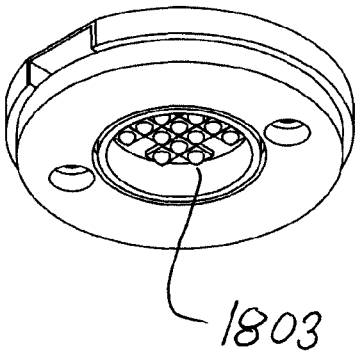

A LED light source/engine which can be used together with the lamp assemblies and heat sinks of FIGS. 13-17 is shown in FIGS. 18*a* and *b*, which are top and bottom views, respectively, of a LED light source 1800 of the type Preva-LED® Core light engines from OSRAM. The LEDs 1803 are arranged at the bottom and at the centre of the light source 1800.

In the above discussion of embodiments of the invention, light emitting diodes, LEDs, have been described for the light sources. It should be understood that the for the embodiments of the present invention, the expression light emitting diodes, LEDs, also covers organic light emitting diodes, OLEDs.

The invention claimed is:

1. A LED lamp assembly comprising:

a heat sink having a center and an outer circumference part, said circumference part supporting a plurality of LEDS, and said circumference part further supporting a plurality of cooling fins extending inwards towards the center from the outer circumference part, wherein at least part of or all of the cooling fins are tilted or partly tilted relatively to a center axis of the heat sink, and wherein the material thickness of the cooling fins decreases inwards from the outer circumference part towards the center of the heat sink.

2. The LED lamp assembly according to claim 1, wherein the tilt angle of the cooling fins decreases from the outer circumference part towards the center of the heat sink.

3. The LED assembly according to claim 1, wherein the width or cross sectional area of the cooling fins decreases in the inward direction from the outer circumference part towards the center of the heat sink.

4. The LED assembly according to claim 1, wherein a major part or all of the LEDs are supported by the outer circumference part of the heat sink.

5. The LED assembly according claim 1, wherein the outer circumference part of the heat sink is made up of two or more separated circumference sub-parts.

6. The LED assembly according to claim 1, wherein the outer circumference part of the heat sink is circumferentially dosed.

7. The LED assembly according to claim 1, wherein the outer circumference part of the heat sink is made of an electrically non-conducting material, such as a ceramic material.

8. The LED assembly according to claim 1, wherein the cooling structure or cooling fins is/are made of an electrically non-conducting material such as a ceramic material.

9. The LED assembly according to claim 6, wherein at least part of the LEDs are surface-mount LEDs, which on the back side have a cathode pad, an anode pad and thermal pad, and wherein the thermal pads are thermally contacting or mounted to the outer circumference part of the heat sink.

10. The LED assembly according to claim 1, wherein the heat sink is made of an electrically conductive material, such as aluminum.

11. The LED assembly according to claim 1, wherein the LEDs are mounted on a printed circuit board, which is mounted to the outer circumference part of the heat sink.

12. The LED assembly according to claim 1, wherein the assembly further comprises a base for holding the heat sink and for providing supply of electrical power to the LEDs.

13. The LED assembly according to claim 12, wherein the base has a number of legs for holding the heat sink, and for providing the supply of electrical power to the LEDs.

14. The LED assembly according to claim 12, wherein the base holds driver circuitry for supplying a DC voltage to the LEDs.

15. The LED assembly according to claim 1, wherein the LEDs supported by the outer circumference of the heat sink are arranged so that the main direction of the emitted light is perpendicular to a center axis of the heat sink.

16. The LED assembly according to claim 1, wherein the LEDs supported by the outer circumference of the heat sink are arranged so that the main direction of the emitted light is parallel to a center axis of the heat sink.

17. The LED assembly according to claim 1, wherein the LEDs supported by the outer circumference of the heat sink are arranged so that the main direction of the emitted light is tilted when compared to a center axis of the heat sink.

18. The LED assembly according to claim 1, wherein lenses or a lens are/is arranged in front of at least part of the LEDs being supported by the outer circumference of the heat sink.

19. The LED assembly according to claim 18, wherein the lens/lenses covers/cover the LEDs being supported by the outer circumference of the heat sink and wherein the lens/lenses is/are made in one piece.

20. The LED assembly according to claim 18, wherein for each LED or at least part of the LEDs a corresponding outwardly pointing convex part is formed on the surface part of the lens/lenses facing the LED.

* * * * *

UNITED STATES PATENT AND TRADEMARK OFFICE

CERTIFICATE OF CORRECTION

PATENT NO. : 9,121,596 B2
APPLICATION NO. : 13/695400
DATED : September 1, 2015
INVENTOR(S) : Alexandra Alexiou et al.

It is certified that error appears in the above-identified patent and that said Letters Patent is hereby corrected as shown below:

In the Claims

In column 15, claim 6, line 51, replace “dosed.” with --closed.--.

In column 16, claim 19, line 45, immediately after “of the heat sink” insert --,--.

Signed and Sealed this
Nineteenth Day of April, 2016

Michelle K. Lee

Michelle K. Lee
*Director of the United States Patent and Trademark Office*